US005482350A

United States Patent [19]

Komorowski et al.

[11] Patent Number: 5,482,350

[45] Date of Patent: Jan. 9, 1996

[54] LINEAR ACTUATION DRIVE MECHANISM FOR POWER-ASSISTED CHAIRS

[75] Inventors: Karl J. Komorowski, Petersburg; Jonathan R. Saul, Erie; Larry P. LaPointe, Temperance; Richard E. Marshall, Monroe, all of Mich.

[73] Assignee: La-Z-Boy Chair Company, Monroe, Mich.

[ * ] Notice: The portion of the term of this patent shall not extend beyond the expiration date of Pat. No. 4,993,777.

[21] Appl. No.: 239,108

[22] Filed: May 6, 1994

Related U.S. Application Data

[63] Continuation-in-part of Ser. No. 154,977, Nov. 19, 1993, which is a continuation-in-part of Ser. No. 951,902, Sep. 28, 1992, Pat. No. 5,314,238, which is a continuation-in-part of Ser. No. 774,536, Oct. 8, 1991, Pat. No. 5,215,351, which is a continuation of Ser. No. 613,355, Nov. 14, 1990, Pat. No. 5,061,010, which is a continuation-in-part of Ser. No. 425,384, Oct. 18, 1989, Pat. No. 4,993,777, which is a continuation of Ser. No. 196,750, May 20, 1988, abandoned.

[51] Int. Cl.[6] ..... A47C 1/035

[52] U.S. Cl. ..... 297/85; 297/325; 297/DIG. 10

[58] Field of Search ..... 297/68, 69, 85, 297/86, 88, 325–328, 330, DIG. 10; 74/89.15, 424.8 R

[56] References Cited

U.S. PATENT DOCUMENTS

| | | | |
|---|---|---|---|
| 942,817 | 12/1909 | Findall | 297/69 X |
| 974,769 | 11/1910 | Hoff | 297/DIG. 10 X |
| 3,016,264 | 1/1962 | Hughes | 297/69 |
| 3,091,426 | 5/1963 | Bogart . | |
| 3,138,402 | 6/1964 | Heyl, Jr. et al. | 297/330 X |
| 3,218,102 | 11/1965 | Specketer . | |
| 3,250,569 | 5/1966 | Gaffney . | |
| 3,343,871 | 9/1967 | Yates et al. . | |
| 3,479,086 | 11/1969 | Sheridan | 297/DIG. 10 X |
| 3,588,170 | 6/1971 | Knabusch et al. . | |
| 3,596,991 | 8/1971 | Mckee et al. . | |
| 3,623,767 | 1/1971 | Condon . | |
| 3,698,673 | 10/1972 | Olsen . | |
| 3,807,795 | 4/1974 | Weant et al. . | |
| 3,848,845 | 11/1974 | Bogart . | |
| 3,851,917 | 12/1974 | Horstmann et al. . | |
| 3,934,929 | 1/1976 | Rabinowitz | 297/330 X |
| 4,007,960 | 2/1977 | Gaffney | 297/330 X |
| 4,076,249 | 1/1978 | Deucher . | |
| 4,076,304 | 2/1978 | Deucher . | |
| 4,083,599 | 4/1978 | Gaffney | 297/DIG. 10 X |
| 4,127,906 | 12/1978 | Zur . | |
| 4,185,335 | 1/1980 | Alvis . | |
| 4,207,960 | 2/1977 | Gaffney . | |
| 4,231,614 | 11/1980 | Shaffer | 297/330 |
| 4,249,774 | 2/1981 | Andreasson . | |
| 4,344,594 | 8/1982 | Hirth | 297/330 X |
| 4,365,836 | 12/1982 | Jackson et al. . | |
| 4,367,895 | 1/1983 | Pacciti . | |

(List continued on next page.)

FOREIGN PATENT DOCUMENTS

| | | | |
|---|---|---|---|
| 77780 | 1/1983 | European Pat. Off. | 297/DIG. 10 |
| 2515508 | 11/1981 | France | 297/DIG. 10 |
| 926157 | 5/1963 | United Kingdom | 297/339 |

*Primary Examiner*—Peter R. Brown
*Attorney, Agent, or Firm*—Harness, Dickey & Pierce

[57] ABSTRACT

The chair disclosed includes a power-assisted linear actuation drive mechanism having a lead screw nut which is linearly movable upon rotation of a power screw for selectively actuating the lift and tilt linkage mechanism for causing forward lifting and tilting movement of the chair when the motor is operated in a first direction. Rotation of the screw shaft in a second opposite direction acts to lower the chair to the normal seating position. Continued rotation in the second direction causes a first cam block pivotably mounted to the lead screw nut to engage a first follower assembly for causing extension of the leg rest assembly. Further rotation in the second direction causes a second cam block pivotably mounted to the lead screw nut to engage a second follower assembly for causing reclining movement of the chair. This sequential operation of the leg rest assembly and the reclining linkage are independent and may be easily disabled to selectively eliminate either of the features.

8 Claims, 13 Drawing Sheets

U.S. PATENT DOCUMENTS

| | | | |
|---|---|---|---|
| 4,385,410 | 5/1983 | Elliott et al. . | |
| 4,386,803 | 6/1983 | Gilderbloom . | |
| 4,407,030 | 10/1983 | Elliott . | |
| 4,453,766 | 6/1984 | DiVito . | |
| 4,533,106 | 8/1985 | Stockl | 297/345 X |
| 4,696,512 | 9/1987 | Burnett et al. | 297/68 |
| 4,722,566 | 2/1988 | Castellini | 297/68 |
| 4,786,107 | 11/1988 | Crockett | 297/330 |
| 4,946,222 | 8/1990 | Matson | 297/325 X |
| 4,993,777 | 2/1991 | LaPointe | 297/325 |
| 5,061,010 | 10/1991 | LaPointe | 297/325 |
| 5,215,351 | 6/1993 | LaPointe | 297/325 |
| 5,314,238 | 4/1994 | Komorowski et al. | 297/325 |

FIG 17
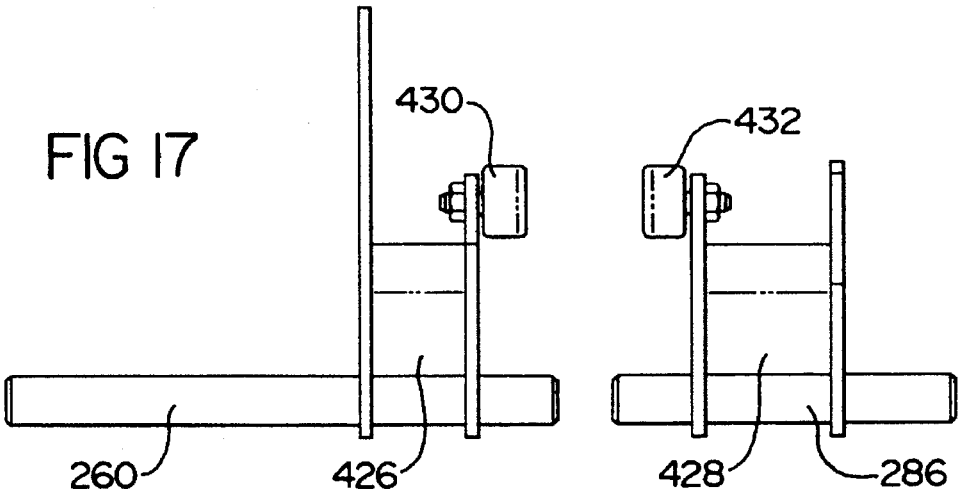
FIG 18
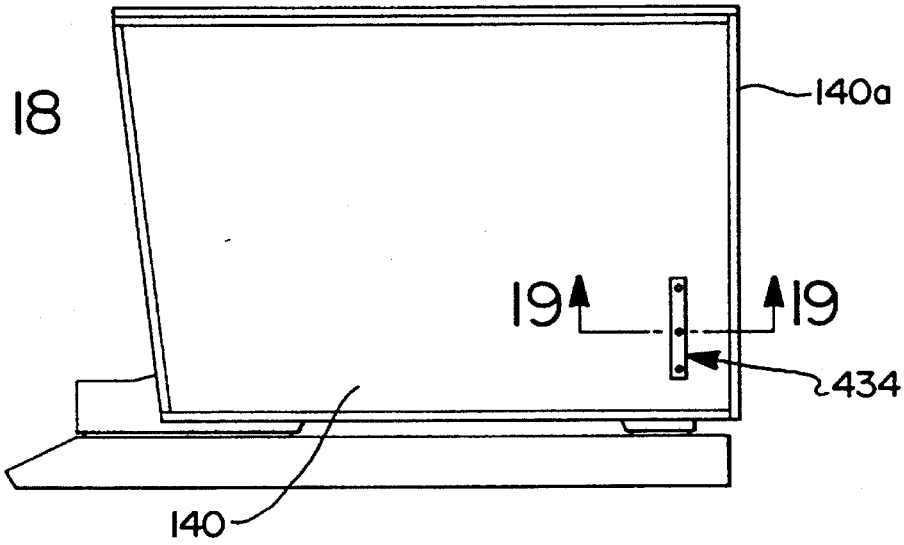
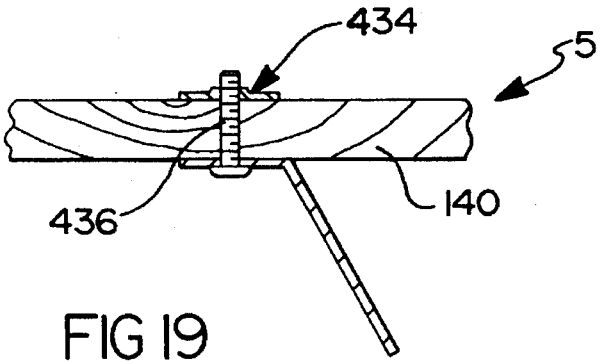
FIG 19

LINEAR ACTUATION DRIVE MECHANISM FOR POWER-ASSISTED CHAIRS

CROSS-REFERENCE TO RELATED U.S. APPLICATIONS

The present application is a Continuation-In-Part of U.S. Ser. No. 08/154,977, filed Nov. 19, 1993, which is a Continuation-In-Part of U.S. Ser. No. 07/951,902 filed Sep. 28, 1992, now U.S. Pat. No. 5,314,238 which is a Continuation-In-Part of U.S. Ser. No. 07/774,536 filed Oct. 8, 1991, now U.S. Pat. No. 5,215,351, which is a Continuation of U.S. Ser. No. 07/613,355 filed Nov. 14, 1990, now U.S. Pat. No. 5,061,010, which is a Continuation-In-Part of U.S. Ser. No. 07/425,384 filed Oct. 18, 1989, now U.S. Pat. No. 4,993,777, which is a Continuation of U.S. Ser. No. 07/196,750 filed May 20, 1988, now abandoned.

BACKGROUND OF THE INVENTION

The present invention relates generally to power-assisted articles of furniture and, more particularly, to a multi-function chair having a linear actuation drive mechanism selectively operable for lifting and tilting the chair, extending and retracting a leg rest assembly and reclining the chair between upright and fully reclined positions.

Conventionally, power-assisted chairs typically include a motor-operated lift mechanism for aiding invalids and those persons requiring assistance in entering or exiting the chair. More particularly, motor-operated lift mechanisms are interconnected between a stationary base assembly and a moveable chair frame. An example of such a power-assisted chair is disclosed in commonly owned U.S. Pat. No. 4,993,777 which issued Feb. 19, 1991, and is entitled "Recliner Chair Lift Base Assembly".

Some power-assisted chairs also include separate linkage mechanisms for permitting the seat occupant to selectively actuate an extensible leg rest assembly and/or produce reclining angular movement of a seat assembly between "upright" and "reclined" positions. However, power-assisted chairs which provide such a multi-functional combination generally require the use of multiple motors for driving (i.e., pushing) the separate linkages which results in extremely large and expensive chair units. Moreover, such power-assisted chairs typically incorporate a drive mechanism which employs both a power "drive" function (i.e., for extending the leg rest, lifting the chair, and reclining the chair) and a power "return" function for returning the chair to the normal seated position.

SUMMARY OF THE INVENTION

Accordingly, the present invention overcomes the disadvantages associated with conventional power-assisted chairs by providing a single linear actuation drive mechanism that is operable for selectively and independently actuating a reclining linkage assembly and a leg rest linkage assembly, in addition to actuating a lift and tilt mechanism for raising, lowering and tilting the chair.

In a preferred form, the power-assisted linear actuation drive mechanism of the present invention includes a driven member which is linearly movable in response to rotation of a motor-driven screw shaft in a first direction for selectively actuating the lift and tilt mechanism for causing forward lifting and tilting movement of the chair. Thereafter, rotation of the motor-driven screw shaft in a reverse or second direction acts to lower the chair to the normal seating position. Continued rotation of the screw shaft in the second direction causes cam means associated with the driven member to sequentially engage a first follower assembly for extending the leg rest assembly and a second follower assembly for causing angular reclining movement of the chair. Moreover, such sequential actuation of the leg rest assembly and the reclining linkage assembly are independent and may be easily disabled to selectively eliminate either of the power-assisted features. In addition, the linear actuation drive mechanism of the present invention also includes adjustable means for permitting precise calibration (i.e., setting) of the fully extended position for the leg rest assembly during final assembly of the power-assisted chair. Furthermore, the adjustable means is also adapted to facilitate in-service re-calibration of the fully extended position for the leg rest assembly.

In an alternative preferred embodiment of the present invention the lift base assembly of the present invention includes a number of novel structural enhancements which even further enhance the rigidity of the various components of the lift base assembly of the present invention and contribute to even further longevity of the lift base assembly while adding little to the overall cost of constructing the lift base assembly.

In the alternative preferred embodiment the single linear actuation drive mechanism includes a modified leg rest follower assembly adapted to even better handle the wear and tear experienced during operation of the leg rest assembly of the power-assisted multi-function chair described herein.

The alternative preferred embodiment further incorporates novel reinforcing structure for reinforcing various pivotally disposed tubular members at the points about which they pivot. Angle reinforcing members are further incorporated to "cradle" a portion of the wooden side rails of a lift base assembly of the actuation mechanism. A single-piece metal reinforcing plate has further been included to provide even further rigidity to the wooden side rails between the points where the drive mechanism couples to the wooden side rails. Numerous other structural improvements are also included to improve the overall strength and rigidity of the structure supporting and coupling the linear actuation drive mechanism to the lift base assembly of the power assisted chair.

Other features and advantages of the present invention will become apparent upon consideration of the drawings and the description set forth hereinafter.

DESCRIPTION OF THE DRAWINGS

FIG. 17 is a front view of a portion of the leg rest follower assembly showing the modified positioning of the cam followers, the increased size of the cam followers, and the modified spacer bars;

FIG. 18 is a side view of a portion of the power assisted chair showing a metal plate for reinforcing securing of a frame member of the chair to each side arm of the power-assisted chair; and FIG. 19 is a cross sectional view of a portion of the side arm in accordance with section line 19—19 in FIG. 18.

DETAILED DESCRIPTION OF THE PREFERRED EMBODIMENT

In general, the present invention is directed to a modified construction for the cam and follower arrangement disclosed in commonly owned U.S. Pat. No. 5,061,010 which issued Oct. 29, 1991, entitled "Cam Guide Drive Mechanism For Power-Assisted Chairs And The Like", the entire disclosure of which is expressly incorporated by reference herein. However, to provide a sufficient basis for one skilled in the art to understand the novelty of the inventive features to be hereinafter disclosed, the following is a thorough discussion of the structure and function of a power-assisted chair constructed according to the preferred embodiments of the present invention.

Figure 1A:
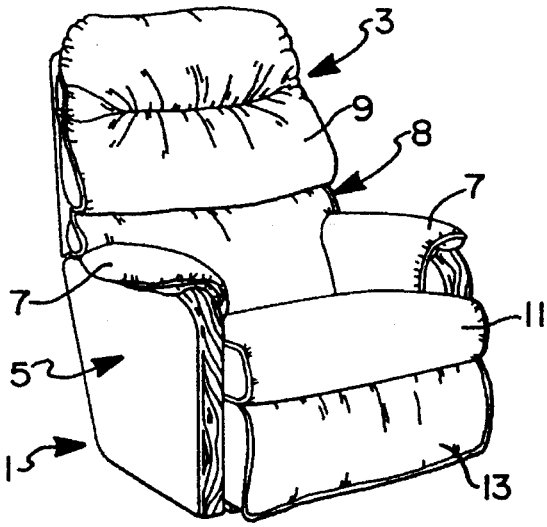
FIGS. 1A through 1D illustrate the various operative seating positions for a power-assisted chair constructed according to a preferred embodiment of the present invention.
Figure 1B:
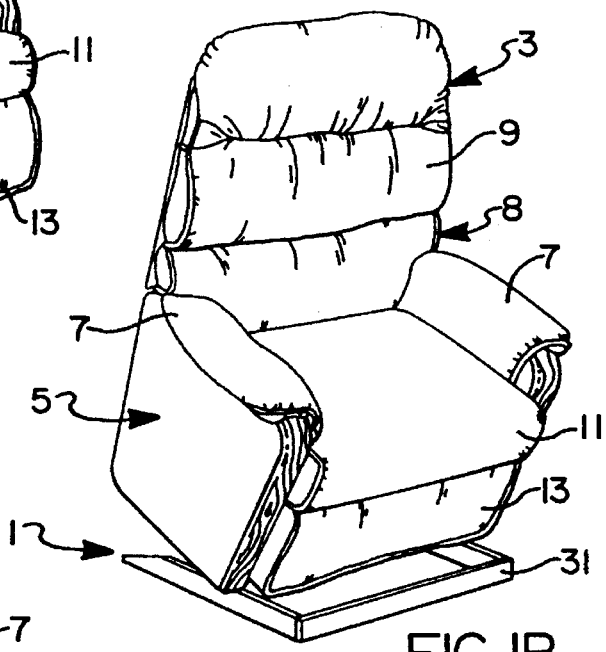
Figure 1C:
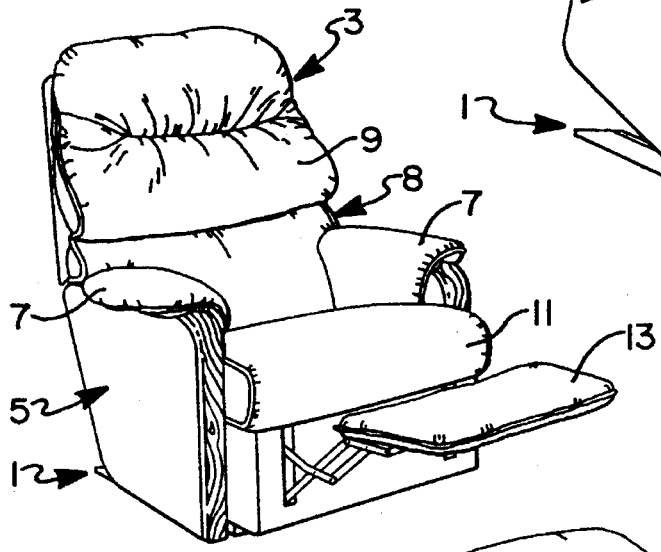
Figure 1D:
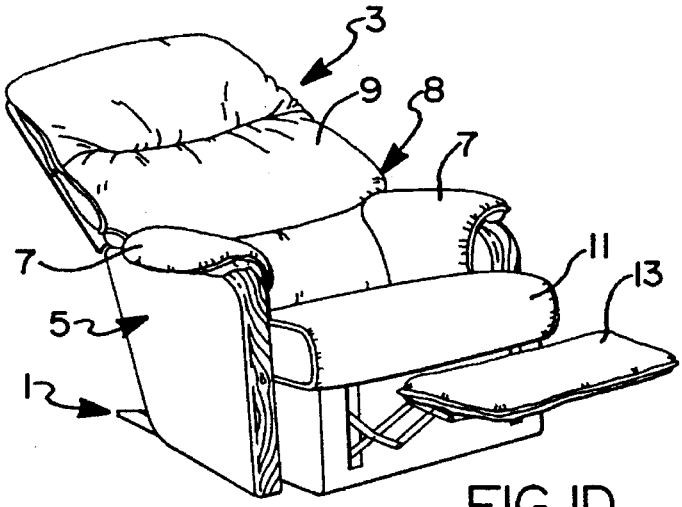

According to the present invention, a lift base assembly 1 is shown in FIGS. 1A through 1D supporting an upholstered chair 3 in various operative positions. While any of a wide variety of chair constructions can be used with lift base assembly 1, a well-known chair sold by the assignee hereof under the registered trademark RECLINA-REST is an example of one type of chair that can be mounted on lift base assembly 1. In general, chair 3 has a frame 5 with side arms 7 and a seat assembly 8 supported from frame 5 and defined by a seat back 9 that may recline in response to pressure applied thereto by a seat occupant and a seat portion 11 that moves simultaneously with seat back 9. Chair 3 also includes an extensible leg rest assembly 13. Thus, FIG. 1A shows upholstered chair 3 in a "normal" seated or "upright" position. FIG. 1B illustrates chair 3 "lifted" to a forward-tilted position upon actuation of a lift and tilt mechanism for making it easier for a person to enter or exit chair 3. Next, FIG. 1C illustrates leg rest assembly 13 in a fully extended position with chair 3 maintained in the upright seated position. Finally, FIG. 1D illustrates chair 3 having seat assembly 8 angularly moved to a fully "reclined" position following extension of leg rest assembly 13.

With particular reference to FIGS. 3 through 6, lift base assembly 1 is shown to have a stationary lower frame member 31 that rests on the floor and a movable upper frame member 33 on which chair 3 is removably but securely attached by suitable fasteners (not shown). Lower frame member 31 includes a pair of laterally-spaced wooden side rails 35 that are rigidly secured to a wooden front cross rail 39. Preferably, side rails 35 have suitable scuff-resistant pads 41 secured to a bottom surface thereof which engage the floor.

Upper frame member 33 has a pair of laterally-spaced wooden side rails 45 that are rigidly interconnected to a wooden rear cross rail 49. Soft rubber-like pads 50 secured to the bottom surface of upper side rails 45 are adapted to help transfer vertically-directed chair loads into bottom side rails 35 when chair 3 is in a non-lifted position. Thus, wooden outer portions of lift base assembly 1 give the appearance of an ordinary chair base. However, the lift and tilt mechanism to be described nests inside of the wooden frame members and within chair frame 5 such that lift base assembly 1 is of a low profile.

Figure 3:
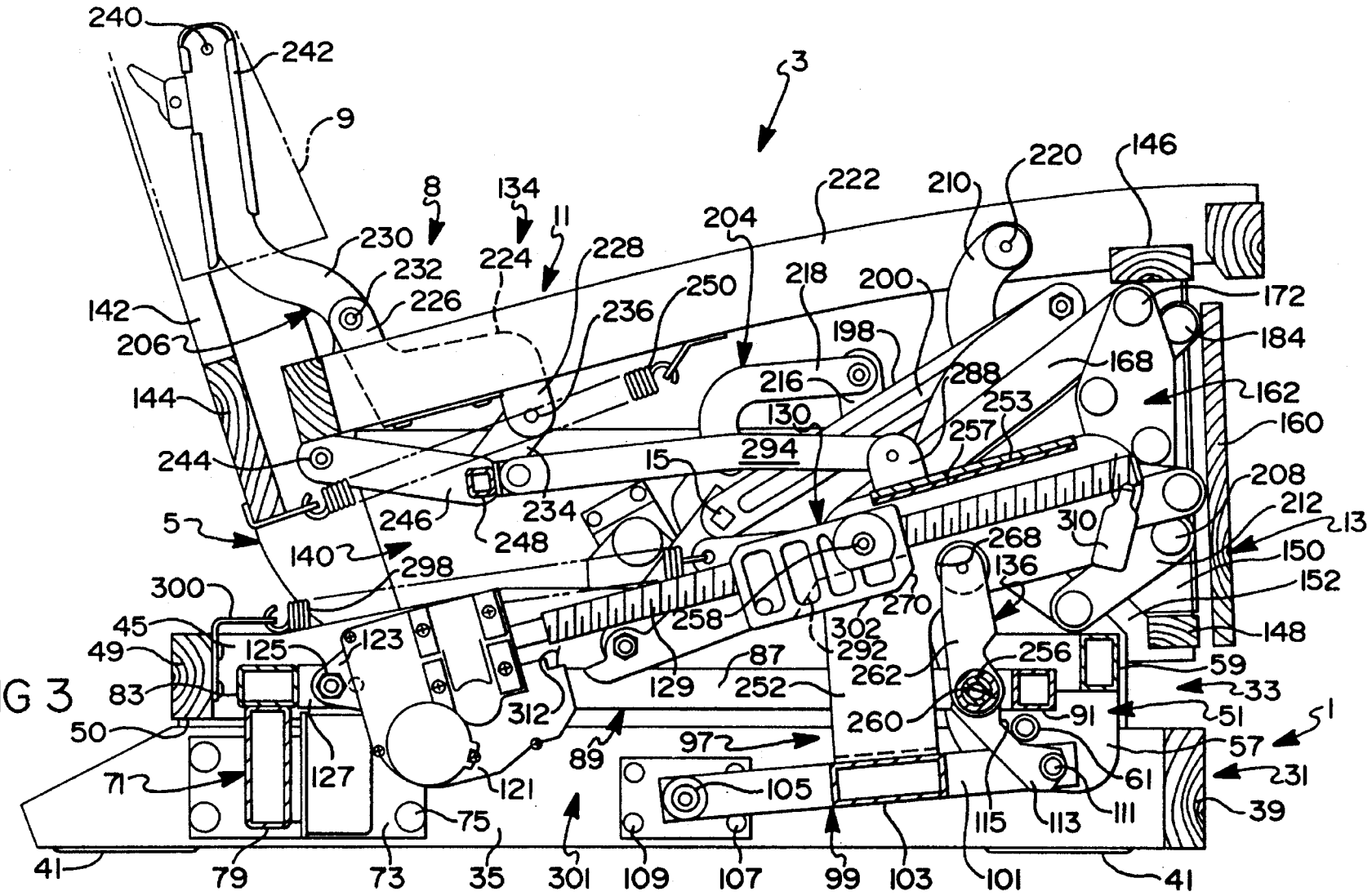
FIG. 3 is a vertical cross-sectional view taken through the power-assisted chair shown in FIG. 1A.

The front of upper frame member 33 is reinforced by a U-shaped pivot bracket 51 having laterally-spaced side plates 53 (FIG. 4) that are securely affixed to the inside faces of wooden side rails 45. In addition, the front ends of side plates 53 are rigidly secured to pivot plates 57 which extend below wooden side rails 45 and into the confines of lower frame member 31, as seen in FIG. 3. As shown, pivot bracket 51 also includes a rectangular tube 59 that acts as a front cross piece between pivot plates 57, and which is made rigid therewith such as by welding. Furthermore, a tubular cross brace 61, located somewhat below and to the rear of front cross piece 59, also extends between pivot plates 57 and is likewise made rigid therewith, as by welding.

The rear of lower frame member 31 is reinforced by a transverse pivot bracket member 71 that includes side plates 73 that are securely affixed to the inside faces of wooden side rails 35, as indicated at 75. Pivot bracket member 71 also includes a rectangular tube 79 that acts as a rear cross piece extending between sides plate 73. Another transverse rectangular tube 83 is fixed on top of tube 79 such that tubes 79 and 83 form a T-shaped load carrying component of lift base assembly 1. Preferably, the height of tube 79 is such that tube 83 is located within the confines of upper frame member 33.

Figure 2:
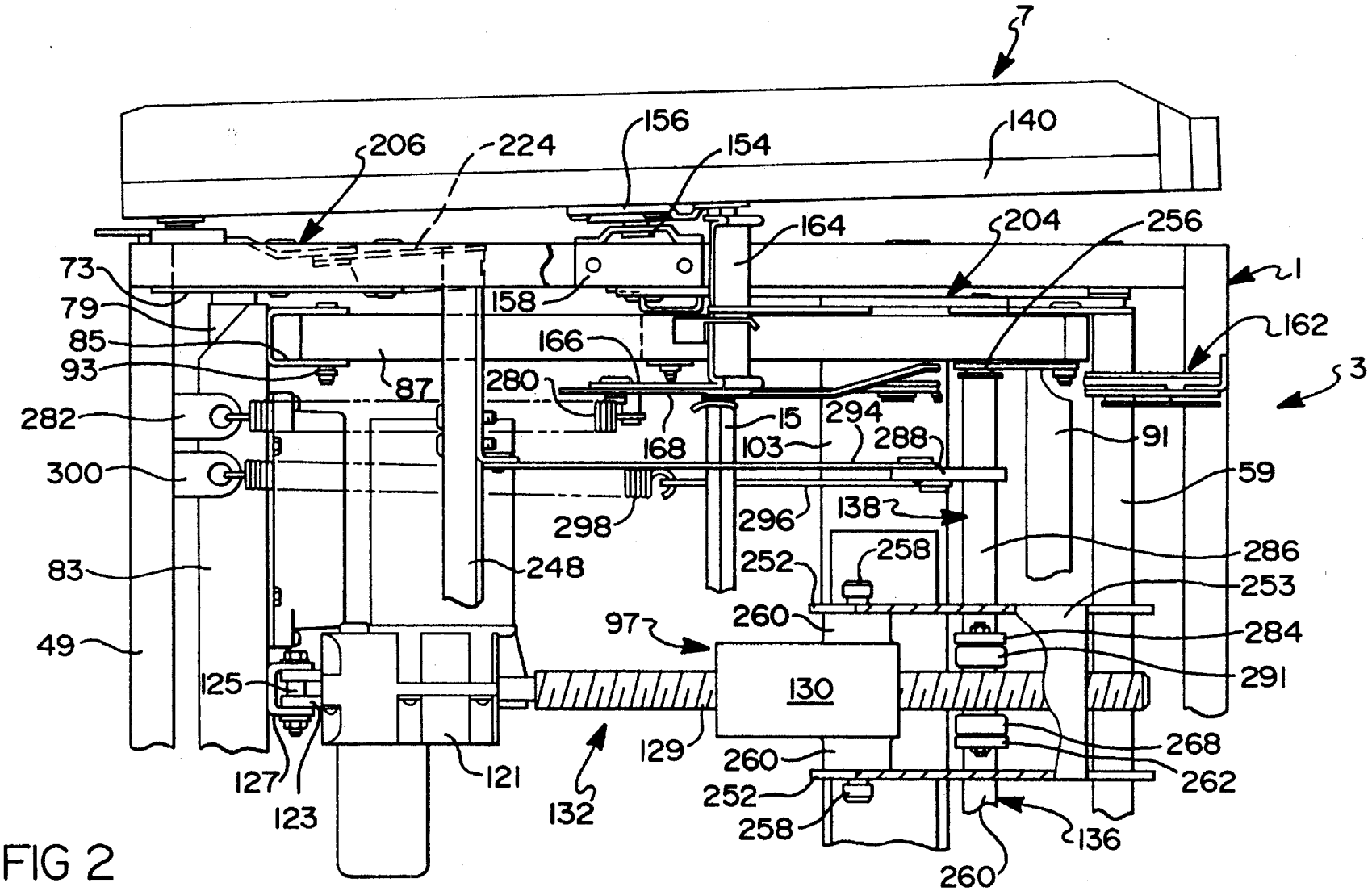
FIG. 2 is a plan view of a left-side portion of the chair frame, with its upholstery removed, illustrating the various components of a power-assisted linear actuation drive mechanism which is adapted to selectively actuate a lift and tilt mechanism, a reclining linkage assembly and a leg rest linkage assembly.

As best seen from FIG. 2, the opposite ends of top tube 83 terminate a slight distance inwardly from side plates 73 and have a U-shaped bracket 85 rigidly affixed in close proximity thereto. Brackets 85 receive the rear ends of laterally-spaced side legs 87 of a U-shaped upper tilt bar member 89, with front ends of side legs 87 being rigidly affixed, such as by welding, to opposite ends of a transversely extending front cross piece 91. More preferably, the rear ends of upper tilt bar side legs 87 fit inside U-shaped brackets 85 on lower frame member 31 and are pivotally attached thereto, as indicated at pivot point 93. In addition, the upper or front ends of side legs 87 are pivotally attached to pivot plates 57 on upper frame member 33. As seen best in FIG. 3, the height of combined tubes 79 and 83 is such that side legs 87 are substantially horizontal when lift base assembly 1 is in the fully lowered or seated position.

Upper tilt bar member 89 is a part of a lift and tilt linkage mechanism 97 that is operably associated with base lift assembly 1. Lift and tilt linkage mechanism 97 also includes a lower lift bar member 99 having tubular side legs 101 that are pivoted at their rear ends to a central portion of lower frame member 31 and at their forward ends to pivot plates 57 of upper frame member 33. More specifically, lower lift bar member 99 is substantially H-shaped and includes a pair of laterally-spaced side legs 101 that are spaced apart the same amount as side legs 87 of upper tilt bar member 89, so as to be substantially coplanar therewith, though substantially shorter in length. A rigid rectangular tube 103, similar to tube 79, extends between side legs 101 and is fixed thereto at central portions of side legs 101. The rearward ends of side legs 101 are pivotally attached at pivots 105 to side brackets 107 that are rigidly secured to the inside faces of lower frame member side rails 35, as indicated at 109. In addition, the upper and front ends of side legs 101 are pivotally attached to lower portions of pivot plates 57, as indicated at pivots 111. A pair of laterally-spaced reinforcement bars 113 are provided to maintain parallelism and are cutout at 115 so that they can pass close to the rear of cross brace tube 61. As seen best in FIG. 3, the various pans of upper tilt bar member 89 and lower lift bar member 99 associated with lift and tilt linkage mechanism 97 are confined within upper and lower frame members 33 and 31, respectively, when lift base assembly 1 is in the lowered or normal seating position. Thus, lift and tilt mechanism 97 is constructed to have a operably low profile and be compact in nature.

In accordance with a preferred construction for lift base assembly 1, a power-assist mechanism is operably connected to lower lift bar member 99 for arcuately pivoting it up or down about pivot pins 105 and, thereby for operatively driving lift and tilt mechanism 97. The power-assist arrangement includes an electric motor 121 having a flange 123 which fits between and is pivotally attached at pivot 125 to opposite sides of a U-shaped pivot bracket 127 that is secured to a central portion of top cross piece 83 of pivot bracket member 71 on lower frame member 31. Motor 121 is selectively operable for rotating an elongated screw shaft 129 in either of a first or second direction. Both motor 121 and rotary screw shaft 129 can arcuately swing up and down in a generally vertical plane about pivot 125. While no attempt is made to limit the specific control system for motor 121, reference can be made to U.S. Pat. No. 5,061,010 for a complete description of a suitable electrical control system as well as the structure of a suitable hand-operated control device for selectively controlling the direction of rotation of screw shaft 129.

With particular reference to FIGS. 3 through 7, the power-assist arrangement of the present invention is shown to also include a linear actuation drive mechanism 132 that is adapted to selectively actuate a reclining linkage assembly 134, leg rest assembly 13, and lift and tilt mechanism 97 in response to energization of motor 121. In general, linear actuation drive mechanism 132 is operable for sequentially and independently actuating leg rest assembly 13 and reclining linkage assembly 134 utilizing a single electric motor 121 and a driven member, hereinafter referred to as cam nut or guide 130. As will be described, screw shaft 129 extends through and drives the internally threaded cam guide 130 such that cam guide 130 moves forwardly or rearwardly along the length of screw shaft 129 upon driven rotation of shaft 129 in one of the first and second directions. More specifically, cam guide 130 is adapted to move linearly relative to screw shaft 129 for sequentially engaging and driving a leg rest follower assembly 136 and a recliner follower assembly 138 which, in turn, are operatively coupled to leg rest assembly 13 and reclining linkage 134, respectively. As will be appreciated, the use of a single power-assisted drive system, such as linear actuation drive mechanism 132, provides for selectively lifting and tilting chair 3 (via lift and tilt mechanism 97), extending and retracting leg rest assembly 13 (via leg rest follower assembly 136), and angularly moving seat back 9 and seat 11 of seat assembly 8 between an "upright" and a "reclined" position (via recliner follower assembly 138).

Chair frame 5 is shown to include left and right side panels 140 having rearwardly sloping uprights 142 with side panels 140 being interconnected by a rear cross member 144 and front top and bottom transverse cross rails 146 and 148, respectively, and which are joined together by bracket plates 150. Bracket plates 150 are secured to vertical uprights 152 located at the front end of side panels 140. As best seen from FIGS. 2 and 6, chair frame 5 is mounted outside and generally on top of lift base assembly 1 and is pivotally secured thereto about a pivot 154 between a bracket 156 fixed to an inner wall of chair frame side members 140 and a second bracket 158 secured to an upper surface of side members 45 of upper frame member 33. In addition, a leg rest board or panel 160 (FIG. 3) is supported upon chair frame 5 by a pair of extensible pantograph leg rest linkage assemblies 162, an example of which is clearly illustrated and described in the U.S. Pat. No. 3,588,170 to E. M. Knabusch et al., issued Jun. 28, 1971 for "Motor-Operated Reclining Chair", the specification and drawings of which are expressly incorporated by reference herein. It is to be understood that pantograph linkages 162 are applied to both lateral sides of chair frame 5 but since both are exactly alike, only one will be described hereinafter with much detail.

As is generally known, pantograph linkages 162 are operably suspended from a square drive shaft 15 which extends transversely to chair frame 5 and is supported between chair frame side members 140 for rotational movement relative thereto. An L-shaped drive bracket 164 (FIG. 2) is coupled for rotation with drive shaft 15 and includes a down-turned operating arm 166. An actuating or long drive link 168 of pantograph linkage 162 is pivotally secured about a pivot 170 to a lower end of arm 166, with the opposite end of drive link 168 being pivotally secured about a pivot 172 to a link 174. Link 174 is pivotally secured about a pivot 176 to a link 178 which, in turn, is pivotally secured about a pivot 180 to the front portion of a mounting bracket 182, one of which is mounted near each lateral end of leg rest panel 160. A pivot 184 secures one end of link 186 to the rear portion of mounting bracket 182 while its opposite end is pivotally secured about a pivot 188 to a link 190 which, in turn, is pivotally secured to a front bracket (not shown) that is supported from top rail 146 of chair frame 5 about a pivot 192. In addition, link 186 is also secured to an intermediate portion of link 174 by a pivot 194, while long drive link 168 is joined to link 190 by a pivot 196. A brace or "spacing" link 198 having a central strengthening rib 200 is pivotally secured at one end to the front bracket at pivot 192 and is journally connected at its opposite end to square drive shaft 15. In operation, brace links 198 prevent any substantial bending of square drive shaft 15 during operation of cam guide 130 when leg rest assembly 13 is being actuated.

Figure 4:
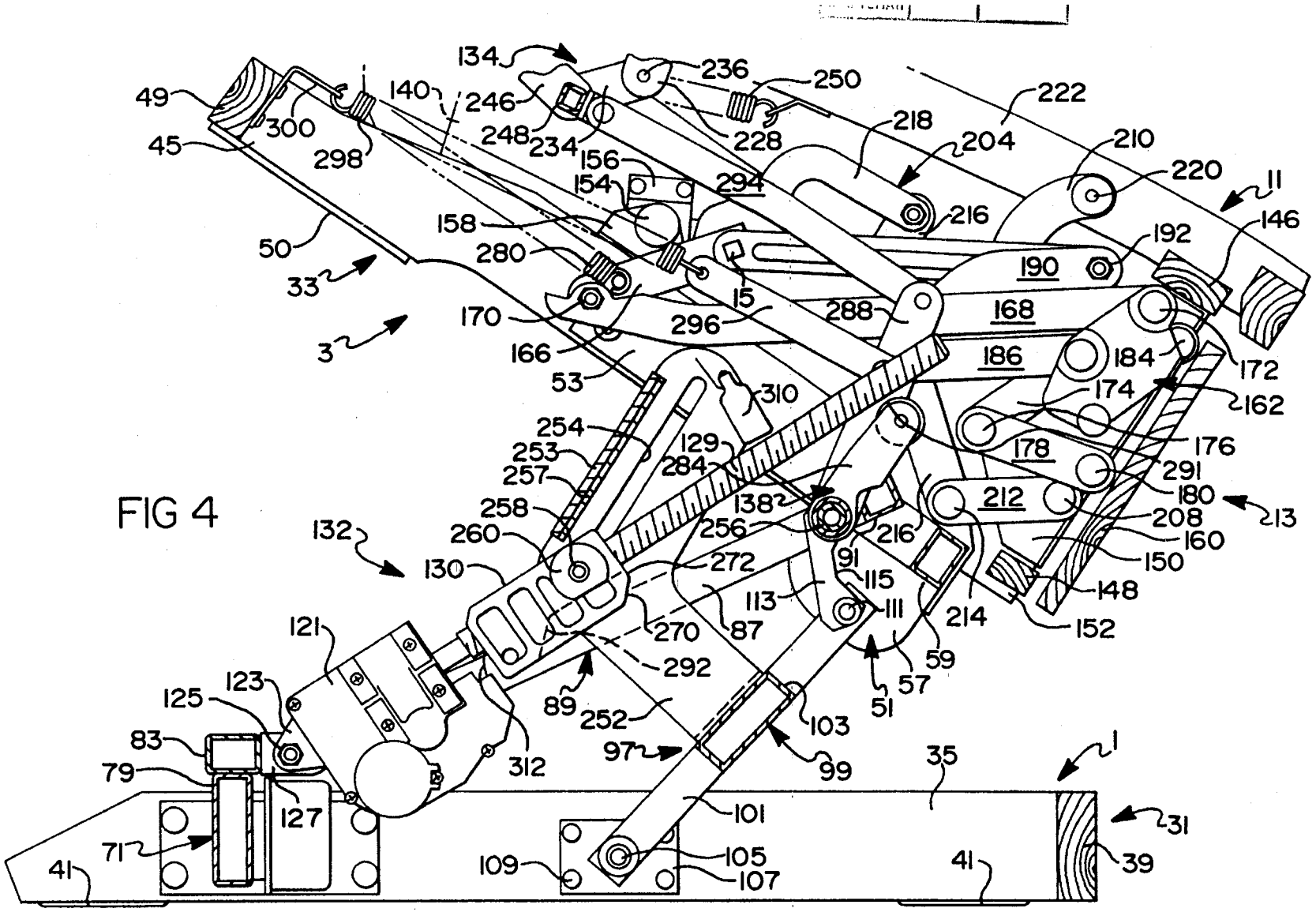
FIG. 4 is a vertical cross-sectional view taken through the power-assisted chair shown in FIG. 1B.
Figure 5:
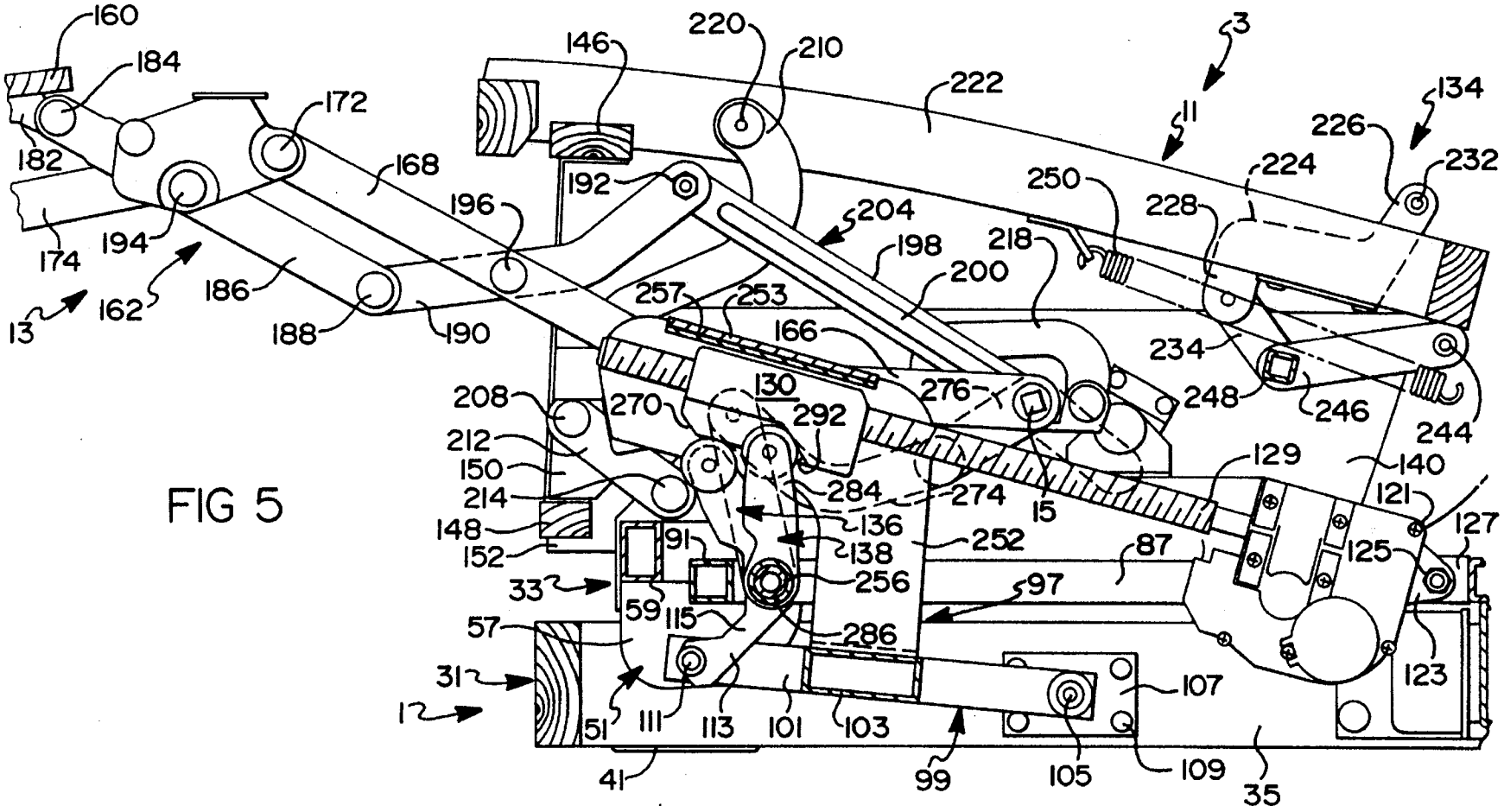
FIG. 5 is an opposite vertical cross-sectional view taken through the power-assisted chair shown in FIG. 1C and showing the leg rest linkage assembly in a fully extended position.
Figure 6:
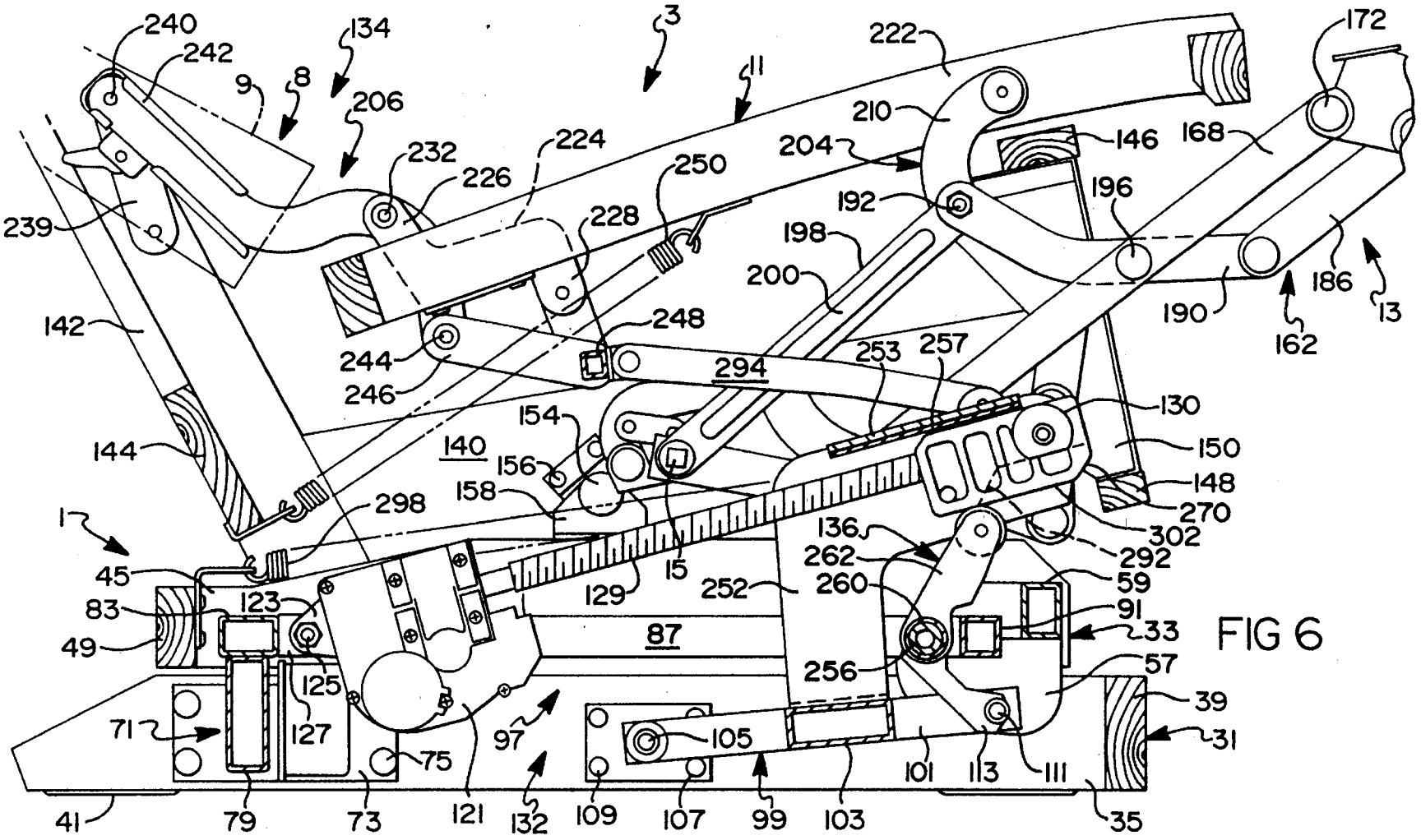
FIG. 6 is a vertical cross-sectional view taken through the power-assisted chair shown in FIG. 1D for illustrating the operative position of the reclining linkage assembly following extension of the leg rest linkage assembly.

With particular reference to FIGS. 4 through 6, reclining linkage assembly 134 is shown which is operable for causing reclining angular movement between seat frame 11 and seat back 9. In general, reclining linkage assembly 134 includes a pair of laterally-spaced front swing linkages 204 and a pair of laterally-spaced rear swing linkage 206. More particularly, each front swing linkage 204 includes a pivot 208 associated with plate bracket 150 which supports an S-shaped link 210, the lower end of which is pivotally secured about pivot 208 to a first end of link 212. The opposite end of link 212 is pivotally connected at pivot 214 to a lower end of link 216. While not shown, an intermediate portion of link 216 is pivotally secured to a pivot bracket attached to a forward upper surface of side rail 45 of upper frame member 33. The upper end of link 216 is pivotally connected to one end of J-shaped toggle link 218 with the opposite end of J-shaped toggle link 218 being pivotably connected to L-shaped bracket 164 which, as noted, is secured for rotation with square drive rod 15. In addition, the upper end of S-shaped links 210 are pivoted on pins 220 on left and right side rails 395 of seat frame 11. In operation, the interaction between the various links associated with front swing linkages 204 cause rearward tilting of chair frame 5 about pivots 154 relative to lift base assembly 1 upon extension of leg rest assembly 13. More particularly, upon drive shaft 15 being rotatably driven in a counterclockwise direction, link 216 pivots on the pivot bracket to cause link 212 to drive the front of chair frame 5 upwardly and rearwardly.

As previously noted, reclining linkage assembly 134 also includes a pair of rear swing linkage 206 each having a seat bracket 224 secured to each of seat frame side rails 222 near the rear end thereof. Bracket 224 has an upwardly extending rear portion 226 and a downwardly extending forward portion 228. An S-shaped link 230 is pivotally secured about a pivot 232 to upstanding rear portion 226 and a link 234 is pivotally secured about a pivot 236 to downwardly extending forward portion 228, the structure being generally similar to that illustrated and described in the above-mentioned U.S. Pat. No. 3,588,170.

An arm link 239 is secured to uprights 142 of chair frame 5 by screws, rivets or any other reliable securing means. In addition, the upper ends of S-shaped links 230 are pivotably secured to arm links 239 about pivot 240 such that when slide brackets 242 secured to back frame 9 are slidably mounted on the upper end of S-shaped links 408, seat back 9 is pivotably movable relative to uprights 142. With this arrangement, seat back frame 9 is supported for forward and rearward reclining movement within chair frame 5. The lower end of S-shaped link 230 is pivotally secured about a pivot 244 to an offset link 246, the opposite end of which is coupled to a tubular crossbar 248 and to which the opposite end of link 234 is pivotally secured. It is to be understood that similar linkages 234 and 246 associated with the opposite lateral side of seat frame 9 are likewise secured to the opposite end of crossbar 248. A spring member 250 is attached between an underside surface of side frames 222 of seat frame 11 and cross rail 144 of chair frame 5 for normally biasing rear swing linkage 206 toward the upright position (FIG. 3).

In accordance with the preferred construction of multi-function power-assisted chair 3, lift and tilt mechanism 97 includes tall L-shaped pivot brackets 252 that are located on opposite sides of screw shaft 129 and rigidly secured to a top surface of cross piece 103 of lower lift bar member 99. Moreover, L-shaped pivot brackets 252 are laterally spaced to permit cam guide 130 to move linearly (fore and aft) therebetween and are each formed to include a set of aligned elongated slots 254. A rigid top plate 253 is secured between L-shaped pivot brackets 252 for maintaining the lateral spacing therebetween. A rigid torque tube 256 is provided which extends transversely between side legs 87 of U-shaped upper tilt bar member 89. Torque tube 256 is located in close proximity to front cross piece 91 for defining the pivot point about which the upper ends of reinforcement brackets 113 are pivotally secured. Guide pins 258 are fixed to opposite transversely extending boss portions 260 of cam guide 130 so as to project through slots 254 in L-shaped pivot brackets 252. As noted, screw shaft 129 extends through and drives internally threaded cam guide 130 such that cam guide 130 moves forwardly or rearwardly along the length of screw shaft 129 upon rotation thereof in response to selective energization of motor 121.

As will be appreciated, and with particular reference to FIG. 3, when chair 3 is in the "normal" seating (i.e., lowered and upright) position, cam guide 130 is positioned near a central portion of screw shaft 129. Lifting and tilting of chair 3 is accomplished by selectively energizing motor 121 to rotate screw shaft 129 in a first direction for drawing cam guide 130 rearwardly toward motor 121. Following a slight amount of initial rotation of screw shaft 129, guide pins 258 on cam guide 130 engage the rearward end stop surfaces of slots 254 such that continued rotation of screw shaft 129 causes lower lift bar member 99 to pivot upwardly about pivots 105 for moving chair frame 5 to the raised and forwardly tilted position shown in FIG. 4. Obviously, rotation of screw shaft 129 in the opposite or second direction will return chair 3 from the lifted and forwardly tilted position of FIG. 4 to the lowered upright position of FIG. 3.

Another unique feature of the present invention encompasses elimination of a "power pinch" condition upon a foreign object or resistances encountered by upper frame member 33 as it is lowered. More particularly, the mechanical interaction of cam guide 130 with lift and tilt mechanism 97 is such that guide pins 258 are free to move forwardly in slots 254 when an obstruction is encountered upon lowering chair frame 5 for eliminating the "power pinch" condition.

Figure 7:
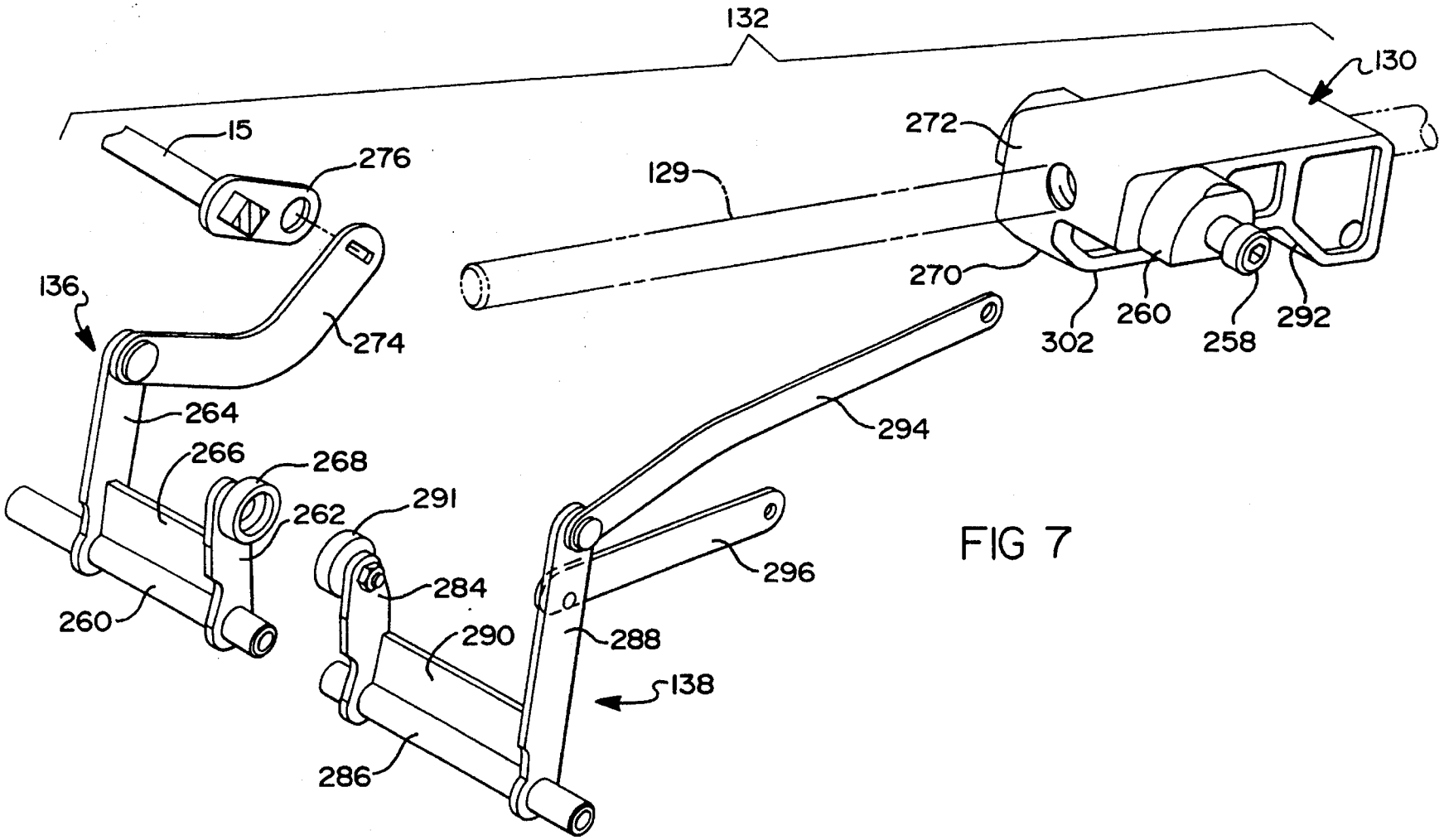
FIG. 7 is an exploded perspective view of a cam and follower arrangement associated with the linear actuation drive mechanism of the present invention.

With particular reference now to FIGS. 5, 6 and 7, means are provided for selectively actuating leg rest assembly 13 and reclining linkage assembly 134 upon selective continued rotation of screw shaft 129 in the second direction. In general, leg rest follower assembly 136 and recliner follower assembly 138 are concentrically mounted for independent pivotable movement on torque tube 256. Leg rest follower assembly 136 is adapted to rotate drive shaft 15 for causing power-assisted actuation of leg rest pantograph linkages 162. Likewise, recliner follower assembly 138 is adapted to drive (i.e., "pull") crossbar 248 for causing power-assisted actuation of reclining linkage assembly 134. Leg rest follower assembly 136 is shown to include a first tubular sleeve 260 concentrically supported on torque tube 256 and on which is secured a first cam lever 262 and a first cam link 264. First cam lever 262 and first cam link 264 are rigidly secured to first tubular sleeve 260 such as by welding and a spacer bar 266 is provided therebetween for supplying additional rigidity. Attached to an upper end of first cam lever 262 is a follower member, such as nylon roller 268, that is adapted to rollingly engage a first cam surface 270 formed on an undersided surface of cam guide 130 and which is generally adjacent to a front transverse end 272 thereof.

First cam link 264 is pivotally connected at its upper end to a first end of toggle link 274, the opposite end of which is connected to a drive link 276. Drive link 276 is coupled to drive shaft 15 for rotation therewith. As such, leg rest follower assembly 136 is designed to interact with first cam surface 270 of cam guide 130 for selectively actuating leg rest pantograph linkages 162 by causing rotation of drive shaft 15. More particularly, as cam guide 130 moves forwardly on screw shaft 129, first cam surface 270 engages first roller 268 such that first cam link 264 is forwardly pivoted on torque tube 256 for causing a corresponding amount of angular movement of drive shaft 15 which, in turn, causes pantograph linkages 162 to extend. Furthermore, a pair of laterally-spaced springs 280 are provided which interconnect each pantograph linkages 162 to a bracket 282 rigidly supported from rear cross frame 49 for normally biasing leg rest assembly 13 toward its retracted or "stored" position. Thus, once first cam surface 270 disengages first follower 260 upon reversing the rotation of screw shaft 129, springs 280 act to forcibly urge leg rest assembly 13 to return to its "stored" position which, in turn, causes a corresponding amount of angular movement of drive shaft 15. As such, since leg rest follower assembly 136 is coupled for rotation with drive shaft 15, springs 280 are further adapted to bias leg rest follower assembly 136 toward the non-engaged positions shown in FIG. 3.

As noted, recliner follower assembly 138 is also installed concentrically about torque tube 256 and includes a second cam lever 284, a second tubular sleeve 286, a second cam link 288 and a second spacer bar 290. A second roller 291 is supported from second cam lever 284 and is adapted to rollingly engage a second cam surface 292 formed on the right half underside surface of cam guide 130. Second cam surface 292 is located sufficiently rearward of first cam surface 270 to permit full extension of leg rest assembly 13 prior to initiation of any reclining movement. This orientation of first cam surface 270 relative to second cam surface 292 is clearly illustrated in reference to FIG. 5. The upper end of second cam link 288 is pivotally connected to an attach link 294 provided for connecting second cam link 288 to tubular cross bar 248. As such, second cam surface 292 acts on second follower 291 of recliner follower assembly 138 for moving cross bar 248 forwardly in response to such forward movement of cam guide 130. As will be appreciated, movement of cross bar 248 causes corresponding movement of reclining linkage assembly 134 for moving chair 3 to the fully "reclined" position of FIG. 6. In addition, one end of a spring link 296 is interconnected to second cam link 288 with its other end secured to one end of a spring member 298. The other end of spring member 298 is supported from a bracket 300 that is rigidly secured to cross rail 49 of upper frame member 33. Thus, spring member 298 is provided for urging second cam link 288 and, in turn, recliner follower assembly 138 rearwardly so as to bias reclining linkage 134 and, in turn, seat assembly 8 toward the "upright" position. Therefore, recliner follower assembly 138 is also adapted to provide spring-biased return means.

In operation, when a hand-operated control device (not shown) is selectively operated by the seat occupant to energize motor 121 for rotatably driving screw shaft 129 in the first direction, chair 3 moves from the "normal" position shown in FIG. 1A to the forward "lifted" position shown in FIG. 1B. More particularly, rotation in the first direction causes cam guide 130 to move rearwardly toward motor 121 such that guide pins 258 engage the rear stop surfaces of slots 254 for pivoting lift and tilt mechanism 97 in the manner heretofore described. As is apparent, selective rotation of screw shaft 129 in the second opposite direction causes chair 3 to be lowered for returning to the normal seating position of FIG. 1A. However, in accordance with the teachings of the present invention, continued rotation of screw shaft 129 in the second direction causes continued forward movement of cam guide 130 relative to screw shaft 129. Thus, guide pins 258 move forwardly through slots 254 until first cam surface 270 formed on the underside of cam guide 130 engages first roller 268 on first cam lever 262 of leg rest follower assembly 136. Continued forward movement of cam guide 130 acts to pivotably drive leg rest follower assembly 136 about torque tube 256, in opposition to the biasing of springs 280, such that first cam link 264 drives toggle link 274 which, in turn, drives connector link 276 for rotating drive shaft 15. In this manner, pantograph leg rest linkages 162 are protracted to their fully extended position of FIG. 5. To inhibit excessive bending of screw shaft 129 in response to engagement of cam guide 130 with follower assemblies 136 and 138, a wear pad 257 is secured to top plate 253 which is sized to provide a clearance with a top surface of cam guide 130. Preferably, wear pad 257 is made of a low-friction material which promotes sliding movement of cam guide 130 upon engagement therewith.

Adjacent first cam surface 270 is a generally planar surface 302 upon which first roller 268 continues to ride during continued forward movement of cam guide 130 following complete extension of leg rest assembly 13. This planar surface 302 permits continued forward movement of cam guide 130 without generating any additional rotation of drive shaft 15. In operation, leg rest assembly 13 can be returned to its retracted position by simply reversing the rotation of screw shaft 129 for moving cam guide 130 rearwardly so as to permit spring members 280 to rearwardly rotate leg rest follower assembly 136 and, in turn, cause concurrent rotation of drive shaft 15. In this manner, the present invention includes spring-biased return means instead of power return typically associated with conventional power-assisted chair units. This is desirable in that this spring-biased return means generates a significantly reduced return force as compared to systems having a power return feature while eliminating the possibility of "power pinch" conditions.

Following full extension of leg rest assembly 13 in the manner described, continued forward movement of cam guide 130 causes engagement between second roller 291 of recliner follower assembly 138 and second cam surface 292. Such engagement acts to forwardly pivot second cam link 288 which, in turn, forwardly drives (i.e. pulls) tubular cross bar 248 via connector link 294 for actuating rear swing linkage 206 and front swing linkage 204, whereby chair 3 is moved to a reclined position. Preferably, a slight amount of linear displacement of cam guide 130 along screw shaft 129 is provided between the end of the point of contact of first follower 268 with first cam surface 270 and the beginning of contact by second follower 291 with second cam surface 292 such that the seat occupant may fully extend leg rest assembly 13 without initiating reclining movement.

To effectively limit the range of motion of power-assisted chair 3, switch means are provided at the forward and rearward ends of screw shaft 129 for terminating rotation thereof. As shown in FIG. 3, a limit switch 310 is provided which is adapted to contact a portion of cam guide 130, such as pin 258, for terminating rotation of screw shaft 129 once cam guide 130 has moved forwardly to a position defining the fully reclined seating position with leg rest assembly 13 also being fully extended (FIG. 6). Similarly, a rear limit switch 31 2 is provided to define a maximum forward tilted position for lift and tilt linkage 97.

As will be appreciated, the present invention can be easily modified to include one or both of leg rest and reclined follower assemblies 136 and 138, respectively. As shown, actuation is preferably sequential when both follower assemblies are utilized. As such, it is possible to manufacture various combinations of power-assisted chair 3 by simply eliminating one of the respective follower assemblies or rendering one of the follower assemblies inoperative. Furthermore, linear actuation drive mechanism 132 is adapted for simple installation into conventional manually actuated drive systems without a significant number of new parts or design changes being required.

Figure 9:
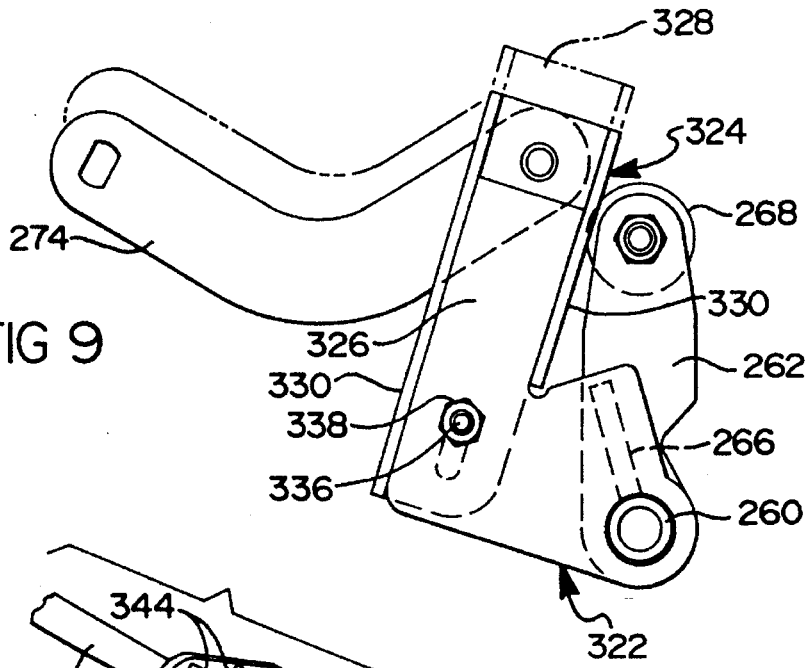
FIG. 9 is an end view of the leg rest follower assembly shown in FIG. 8.
Figure 8:
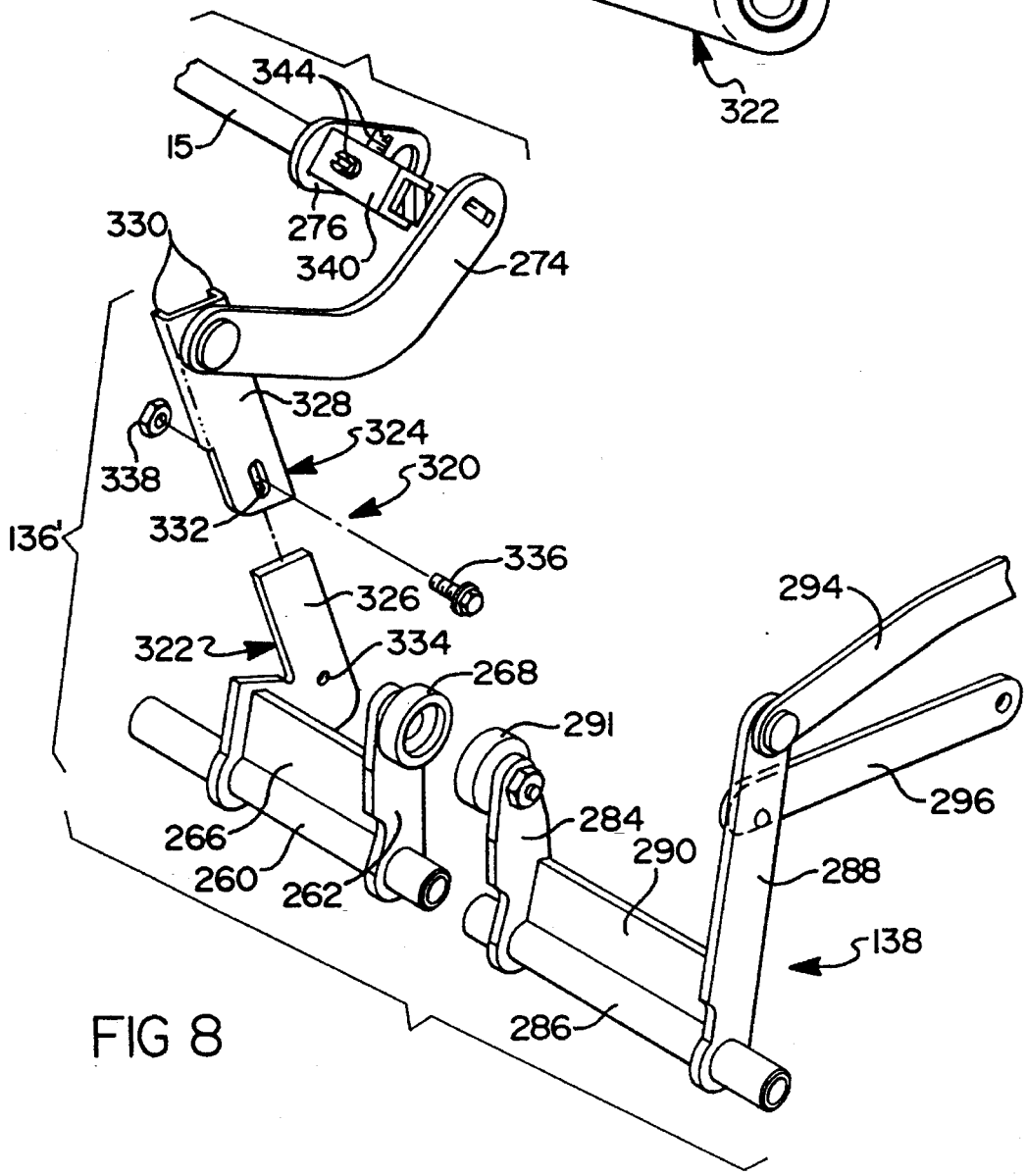
FIG. 8 is an exploded view, generally similar to portions of FIG. 7, showing a modified construction for the follower assembly used to actuate the leg rest linkage assembly.

With particular reference now to FIGS. 8 and 9, an alternative construction for the leg rest follower assembly is shown which is identified by reference number 136'. In general, the modified construction is substantially similar to leg rest follower assembly 136 with the exception adjustment means are now provided for permitting the fully extended leg rest position to be simply and accurately set (i.e., "calibrated") during final assembly of chair 3 and which practically eliminates problems inherent with conventional linkage tolerance stack-ups. In addition, the adjustment means is also highly desirable in that in-service re-calibration of the extended position for leg rest 13 can be quickly accomplished without the requirement of replacing or reworking any linkages. Due to the similarity of several components of leg rest follower assembly 136' to those previously described, like numbers are used to designate like components.

In general, the adjustment means associated with modified leg rest follower assembly 136' includes a two-piece first cam link 320 having a fixed member 322 secured to first tubular sleeve 260 and an adjustable member 324 pivotably coupled to a first end of toggle link 274. Fixed member 322 has an elongated leg portion 326 that is adapted to be slidably disposed within an open-channel portion of adjustable member 324. More specifically, the open channel of adjustable member 324 is defined by a planar segment 328 and a pair of laterally-spaced and transversely extending edge flanges 330 which are adapted to retain leg portion 326 of fixed member 322 therein. An elongated slot 332 is formed in planar segment 328 of adjustable member 324 and is adapted to be adjustably alignable with a bore 334 formed in leg portion 326 of fixed member 322. A suitable fastener, such as a threaded bolt 336, is adapted to extend through bore 334 and slot 332 and is releasably retained therein by a suitable locking member, such as nut 338. To provide additional rigidity, drive link 276 has a square tubular sleeve 340 fixed (i.e., welded) thereto that is aligned with a square aperture (not shown) formed in drive link 276 and through which drive shaft 15 extends. A pair of set screw 344 are retained within threaded bores formed through tubular sleeve 340 and which are adapted to lockingly engage an outer surface of drive shaft 15 for fixing the orientation of drive link 276 relative to drive shaft 15.

During final assembly of chair 3, the second end of toggle link 274 is coupled to drive link 276. Thereafter, adjustable member 324 is slidably inserted over fixed member 322 such that leg portion 326 is retained between end flanges 330 and against planar segment 328. Next, leg rest follower assembly 136' is pivoted forwardly to rotate drive shaft 15 until pantograph linkages 162 are adequately extended for positioning leg rest frame board 160 at the desired elevated position. Following this calibration step, threaded bolt 336 is inserted through the aligned bore 334 and slot 332, and nut 338 is sufficiently tightened thereon to releasably secure adjustable member 324 to leg portion 326 of fixed member 322. Thus, this arrangement eliminates the inherent problems encountered with typical tolerance stack-ups between the various links of pantograph linkages 162 as well as inaccuracies in the initial angular relationship between drive shaft 15 and first follower 268. Moreover, such an arrangement facilitates easy in-service re-calibration of the elevated position of frame board 160 by simply re-adjusting the relationship between fixed member 322 and adjustable member 324. Moreover, such in-service re-calibration, which may be necessitated due to sagging of frame board 160 from worn pivotal connections between the various moving linkages, can be accomplished without the requirement of disassembling chair 3 and replacing pantograph linkages 162.

Figure 10:
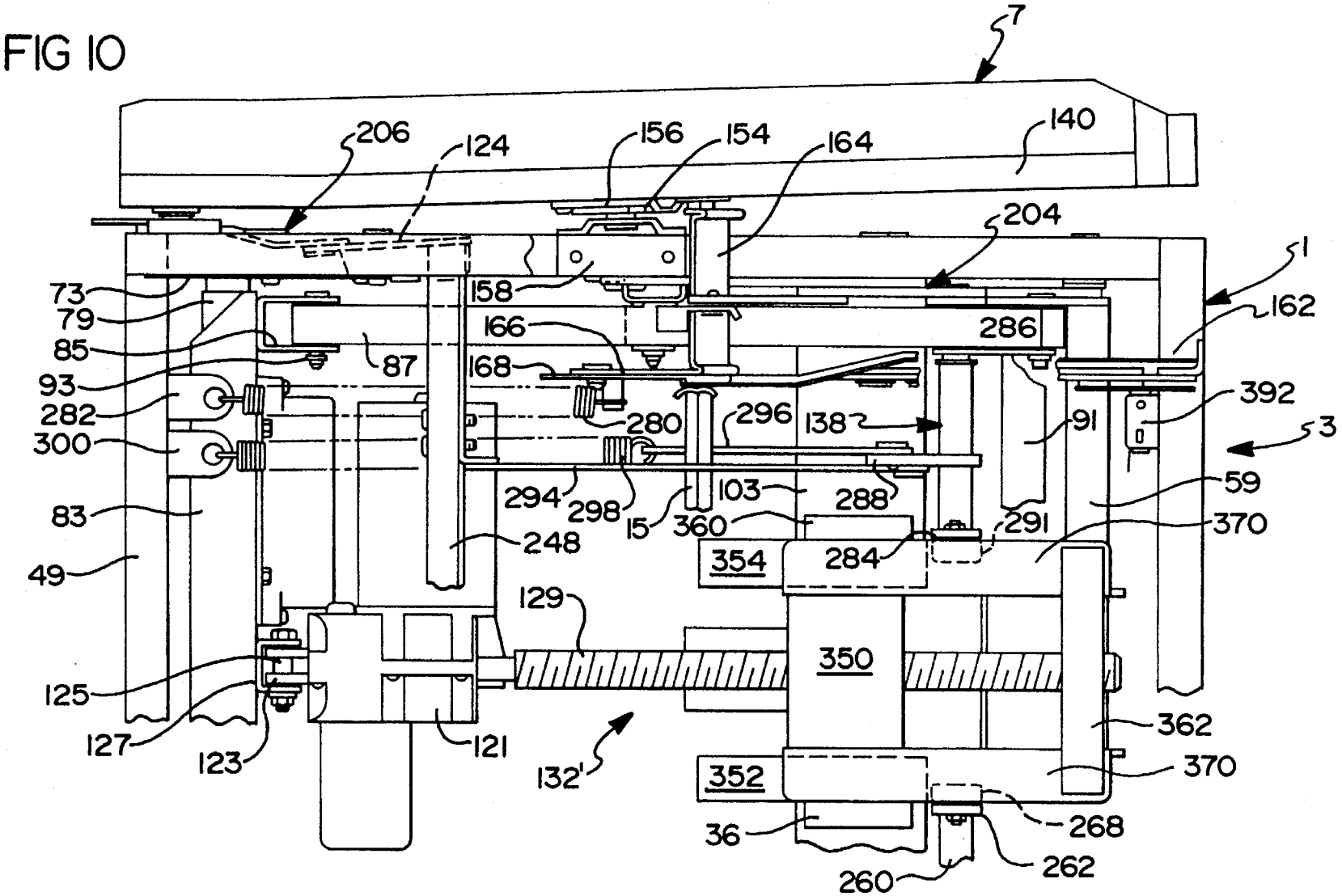
FIG. 10 is a plan view, similar to FIG. 2, illustrating an alternative construction of the power-assisted linear actuation drive mechanism according to another preferred embodiment of the present invention.
Figure 11:
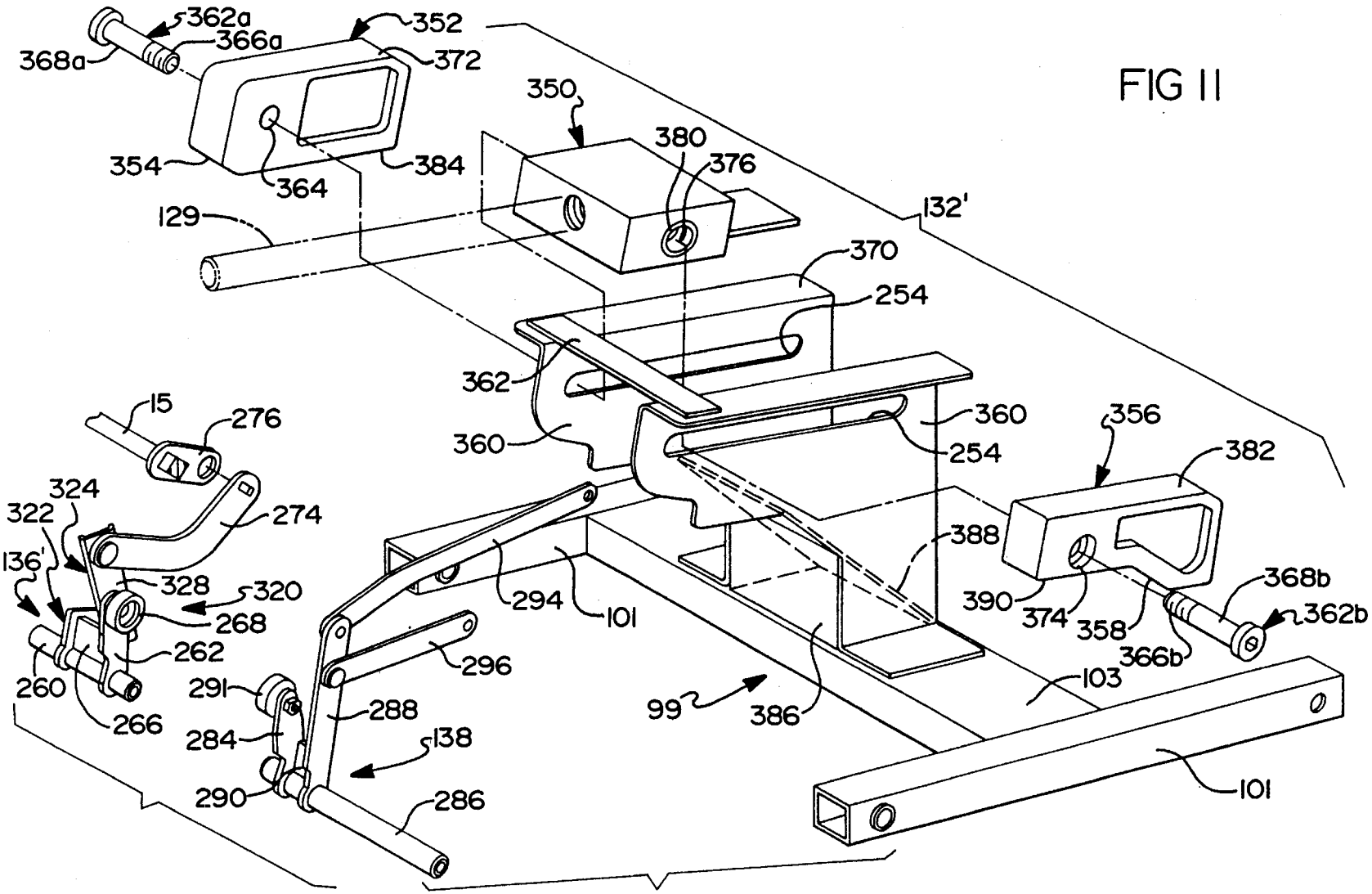
FIG. 11 is an exploded perspective view of the various components associated with the linear actuation drive mechanism shown in FIG. 10.

With particular reference now to FIGS. 10 and 11, an alternative preferred construction for the linear actuation drive mechanism is shown and identified by reference numeral 132'. In general, linear actuation drive mechanism 132' is similar in function and structure to linear actuation drive mechanism 132 with the exception that cam guide 130 is now a multi-piece assembly. Accordingly, due to the similarity of several components of linear actuation drive mechanism 132' to those components previously described in reference to linear actuation drive mechanism 132, like numbers are used hereinafter to designate like components. Thus, it will be readily understood from the following disclosure that linear actuation drive mechanism 132' can be incorporated into power-assisted chair 3 for permitting selective movement thereof to the various operative positions shown in FIGS. 1A through 1D.

In general, linear actuation drive mechanism 132' is operable for selectively actuating reclining linkage assembly 134, leg rest assembly 13, and lift and tilt mechanism 97 utilizing a single electric motor 121 and an internally threaded driven member, hereinafter lead screw nut 350. Moreover, screw shaft 129 extends through and drives the internally threaded lead screw nut 350 such that lead screw nut 350 moves forwardly or rearwardly (i.e., "fore and aft") along the length of screw shaft 129 upon driven rotation of screw shaft 129 in one of the first and second positions. As previously disclosed, rotation of screw shaft 129 in the first direction results in linear movement of lead screw nut 350 toward motor 121 while rotation in the second direction results in linear movement of lead screw nut 350 away from motor 121. As further noted, the particular direction and amount of rotation of screw shaft 129 can be controlled by selectively energizing motor 121 via a hand-held control device (not shown).

With continued reference to FIGS. 10 and 11, a leg rest cam block 352 is shown to be pivotably fixed to one lateral edge of lead screw nut 350. Leg rest cam block 352 is further shown to include a first cam surface 354 formed on an underside surface thereof that is adapted for engagement with first roller 268 of leg rest follower assembly 136'. Similarly, a recliner cam block 356 is shown to be pivotably fixed to the opposite lateral edge of lead screw nut 350 and has a second cam surface 358 formed on an underside surface thereof which is adapted for engagement with second follower 291 of recliner follower assembly 138. Thus, forward linear movement of lead screw nut 350 relative to screw shaft 129 is operable for causing leg rest cam block 352 to engage and pivotably displace leg rest follower assembly 136' for actuating leg rest assembly 13 in a manner substantially identical to that disclosed above. Furthermore, continued forward linear movement of lead screw nut 350 on screw shaft 129 is adapted to cause recliner cam block 356 to engage and pivotably displace recliner follower assembly 138 for actuating recliner linkage 134 in a substantially identical manner to that disclosed above. While not critical to the operation of linear actuation drive mechanism 132', it is preferable that both leg rest cam block 352 and recliner cam block 356 be fabricated from a rigid plastic material such as, for example, nylon or the like.

As will again be appreciated, the use of a single power-assisted drive system, such as linear actuation drive mechanism 132', provides a simple yet effective means for selectively lifting and tilting chair 3 (via lift and tilt mechanism 97), extending and retracting leg rest assembly 13 (via leg rest follower assembly 136'), and angularly moving seat back 9 and seat 11 of seat assembly 8 between an "upright" and a "reclined" position (via recliner follower assembly 138). In essence, leg rest cam block 352 and recliner cam block 356 are adapted to provide the "camming" functions previously associated with cam surfaces 270 and 292, respectively, of cam guide 130. However, due to the pivotable interconnection between each cam block and lead screw nut 350, bending loads exerted by lead screw nut 350 on threaded screw shaft 129 during linear movement thereof are significantly minimized. Moreover, the use of separate cam blocks 352 and 354 provides a simple arrangement for manufacturing various combinations of power-assisted chairs 3 by using one or both of leg rest cam block 352 and recliner cam block 356. Furthermore, in-service repair or replacement of one of the cam blocks can be accomplished without removing motor assembly 121 such that lead screw nut 350 need not be removed from screw shaft 129.

According to the modified construction shown in FIGS. 10 and 11, lift and tilt mechanism 97 now includes a pair of laterally-spaced L-shaped pivot brackets 360 (which are similar in function and structure to pivot brackets 252) that are located on opposite sides of screw shaft 129 and rigidly secured to a top surface of cross piece 103 of lower lift bar member 99. L-shaped pivot brackets 360 are laterally spaced to permit and guide the linear movement (fore and aft) of lead screw nut 350 therebetween and are formed to each include an elongated slot 254. In addition, a rigid cross rail 362 is secured between a forward end of pivot brackets 360 for maintaining the lateral spacing therebetween. As noted, leg rest cam block 352 is pivotably secured to one lateral side of lead screw nut 350 while recliner cam block 356 is pivotably secured to the other lateral side thereof. As will be described, both cam blocks are adapted to move linearly in concert with lead screw nut 350 upon rotation of screw shaft 129 in response to selective actuation of motor 121. In operation, first cam surface 354 of leg rest cam block 352 is engageable with first roller 268 of leg rest follower assembly 136' for causing corresponding angular movement of drive shaft 15 which, in turn, results in a corresponding amount of extensible movement of leg rest pantograph linkages 162. Similarly, second cam surface 358 of recliner cam block 356 is engageable with second roller 291 of recliner follower assembly 138 for causing corresponding movement of reclining linkage 134 and, in turn, a corresponding amount of "reclining" movement of seat assembly 8.

As best seen from FIG. 11, leg rest cam block 352 is positioned adjacent an outer lateral surface of one of L-shaped pivot brackets 360 and is pivotably fixed to the corresponding lateral edge of lead screw nut 350 via a first guide pin **362*a*. More specifically, guide pin 362*a* extends through a non-threaded bore 364 formed through leg rest cam block 352 and through slot 254 in L-shaped pivot bracket 360 such that a threaded portion 366*a* thereof is threaded into a thread bore (not shown) formed in one lateral edge of lead screw nut 350. Preferably, leg rest cam block 352 is journally supported for pivotable movement on a non-threaded portion 368*a* of first guide pin 362*a*. Moreover, an outwardly extending transverse flange segment 370 formed at the uppermost portion of pivot bracket 360 is adapted to be slidably engageable with an upper planar surface 372 of leg rest cam block 352 so as to limit pivotable movement thereof during linear movement. In addition, flange segment 370 is also adapted to maintain alignment of leg rest cam block 352 upon linear movement thereof and particularly upon engagement with first roller 268 of leg rest follower assembly 136'**.

Similarly, recliner cam block 356 is positioned adjacent an outer lateral surface of the other one of L-shaped pivot brackets 360 and is pivotably fixed to the corresponding lateral edge of lead screw nut 350 via a second guide pin **362*b*. Guide pin 362*b* extends through a non-threaded bore 374 formed through recliner cam block 356 and through slot 254 in the corresponding L-shaped pivot bracket 360 such that a threaded portion 366*b* thereof is threaded into a threaded bore 376 formed in the corresponding lateral edge of lead screw nut 350. Preferably, a threaded insert 380 which is, for example made of brass, is molded into each lateral edge of lead screw nut 350 for threaded receipt of guide pins 362 and 362*b*. Again, it is preferred that recliner cam block 356 be journally supported for pivotable movement on a non-threaded portion 368*b* of guide pin 362*b*. Moreover, the outwardly extending transverse flange segment 370 formed on the pivot bracket 360 located adjacent to recliner cam block 356 is likewise adapted to be slidably engageable with an upper planar surface 382 of recliner cam block 356** for maintaining alignment as well as guiding linear movement thereof.

As will be appreciated, when chair 3 is in the "normal" seating (i.e., lowered and upright) position of FIGS. 1A and 3, lead screw nut 350 is positioned near a central portion of screw shaft 129. Lifting and tilting of chair 3 is accomplished by selectively energizing motor 121 via the hand-operated control device (not shown) to rotate screw shaft 129 in the first direction for drawing lead screw nut 350 rearwardly toward motor 121. Following a slight amount of initial rotation of screw shaft 129, guide pins **362*a* and 362*b* engage the rearward end stop surfaces of slots 254 in pivot brackets 360 such that continued rotation of screw shaft 129 in the first direction causes lower lift bar member 99 to pivot upwardly about pivots 105 for moving chair frame 5 to the raised and forwardly tilted or "lifted" position shown in FIGS. 1B and 4. Again, subsequent rotation of screw shaft 129 in the opposite or second direction will return chair 3 from the lifted and upwardly tilted position of FIG. 4 to the lowered position of FIG. 3**.

In accordance with the teachings of the present invention, with chair 3 in the normal seated position of FIGS. 1A and 3, rotation of screw shaft 129 in the second direction causes forward movement of lead screw nut 350 and, in turn, cam blocks 352 and 356 relative to screw shaft 129. Thus, guide pins **362*a* and 362*b* move forwardly through slots 254 until first cam surface 354 of leg rest cam block 352 engages first roller 268 on first cam lever 262 of leg rest follower assembly 136'. Continued forward movement of lead screw nut 350 acts to pivotably drive leg rest follower assembly 136' about torque tube 256 such that cam link 320 drives toggle link 274 which, in turn, drives connector link 276 for rotating drive shaft 15. In this manner, pantograph leg rest linkages 162 may be protracted to their fully extended position of FIGS. 1C and 5. To inhibit excessive up/down bending of screw shaft 129 in response to engagement of leg rest cam block 352 with leg rest follower assembly 136', leg rest cam block 352 is pivotably moveable about guide pin 362***a* relative to lead screw nut 350 for maintaining sliding engagement between its top surface 372 and flange segment 370 of pivot bracket 360. As such, the loading transferred from leg rest cam block 352 to lead screw nut 350 and ultimately to screw shaft 129 is significantly reduced. The pivotable relationship between recliner cam block 356 and lead screw nut 350 is likewise adapted to minimize the loading ultimately transferred to screw shaft 129 in a similar fashion. As noted, leg rest cam block 352 and recliner cam block 356 are preferably made of a low-friction material such as, without limitation, nylon or the like which promotes smooth sliding movement thereof upon engagement with flange segments 370. In order to provide further stability first and second gusset members, 386 and 388, respectively, are weld to the lower portion of pilot brackets 360. Gussets 386 and 388 prevent side deflection of pivot brackets 360, and therefore, prevent side-to-side deflection of screw shaft 129.

As seen from FIG. 11, adjacent first cam surface 354 is a generally planar surface 384 upon which first roller 268 continues to ride during continued forward movement of lead screw nut 350 following complete extension of leg rest assembly 13. This planar surface 384 permits continued forward movement of leg rest block 352 without generating any additional rotation of drive shaft 15. In operation, leg rest assembly 13 can be returned to its retracted position by simply reversing the rotation of screw shaft 129 for moving lead screw nut 350 and leg rest cam block 352 rearwardly so as to permit spring members 280 to forcibly urge leg rest follower assembly 136 to rotate rearwardly and, in turn, cause concurrent rotation of drive shaft 15. As noted, such spring-biased return means generates a significantly reduced return force as compared to systems having a power return feature while concurrently eliminating the possibility of "power pinch" conditions.

During engagement of first follower 268 with cam surface 354, second follower 291 rides on a forward planar surface 390 located adjacent cam surface 358 and which permits a predetermined amount of forward linear movement of recliner cam block 356 without generating pivotable movement of recliner follower assembly 138. However, following full extension of leg rest assembly 13 in the manner described, continued forward movement of lead screw nut 350 causes engagement between second cam surface 358 of recliner cam block 356 and second roller 291 of recliner follower assembly 138. Such engagement acts to forwardly pivot second cam link 288 which, in turn, forwardly drives (i.e. pulls) tubular cross bar 248 via connector link 294 for concurrently actuating rear swing linkage 206 and front swing linkage 204, whereby chair 3 is moved toward the "reclined" position of FIG. 1D. Preferably, a slight amount of linear displacement of lead screw nut 350 along screw shaft 129 is provided between the end of the point of contact of first follower 268 with cam surface 354 and the beginning of contact of follower 291 with second cam surface 358 such that the seat occupant may fully extend leg rest assembly 13 without initiating reclining movement.

To effectively limit the range of motion of power-assisted chair 3, switch means are provided at the forward and rearward ends of screw shaft 129 for terminating rotation thereof. As shown in FIG. 10, a limit switch 392 is fixed to a stationary portion of either chair frame 5 or base 1 and which is adapted to contact a portion of recliner follower assembly 138, such as link 288, for terminating rotation of screw shaft 129 in the second direction once lead screw nut 350 has moved forwardly to a position defining the fully "reclined" seating position with leg rest assembly 13 also being fully extended (FIGS. 1A and 6). Similarly, rear limit switch 312 is provided to define a maximum forward tilted position for lift and tilt linkage 97.

As will be appreciated, both preferred embodiments of the present invention can be easily modified to include one or both of leg rest and reclined follower assemblies 136' (or 136) and 138, respectively. As shown, actuation is sequential when both follower assemblies are utilized. As such, it is possible to manufacture various combination recliner chairs 3 by simply eliminating one of the respective follower assemblies, rendering one of the follower assemblies inoperative, or eliminating one of the separate cam blocks. Furthermore, linear actuation drive mechanisms 132 and 132' are adapted for simple installation into conventional manually actuated drive systems without a significant number of new parts or design changes being required.

Chair 3 is especially useful for invalids since by pressing switches on the hand-operated control device the seat occupant can change his position on the seat to provide greater comfort when desired. If the disability of the occupant is such as to render the occupant unable to reach switches mounted on the side of chair 3, it is within the purview of the invention to provide a switch box which may rest on his lap and be operated by the simple movement of a finger.

Figure 12:
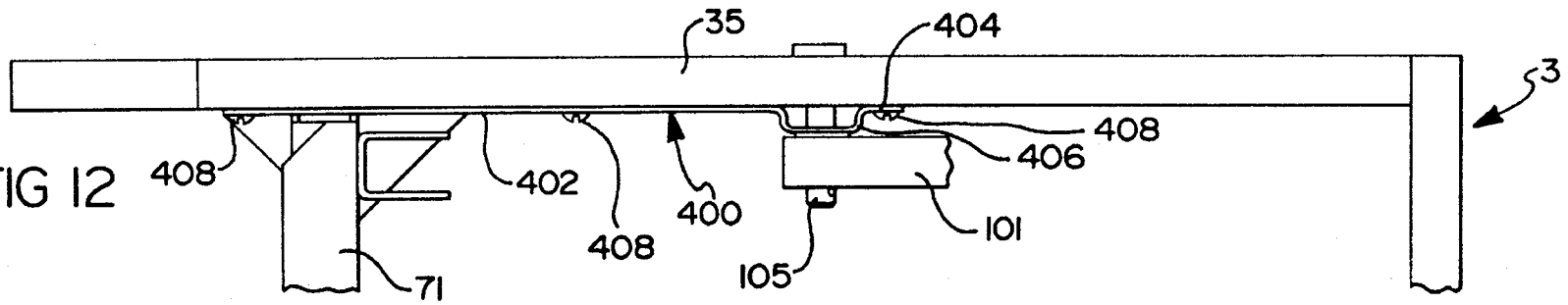
FIG. 12 is a top, elevational, fragmentary view of a portion of the lift base assembly showing the metal attachment plate used to reinforce each wooden side rail between the points where the actuation drive mechanism is supported on each wooden side rail.
Figure 13:
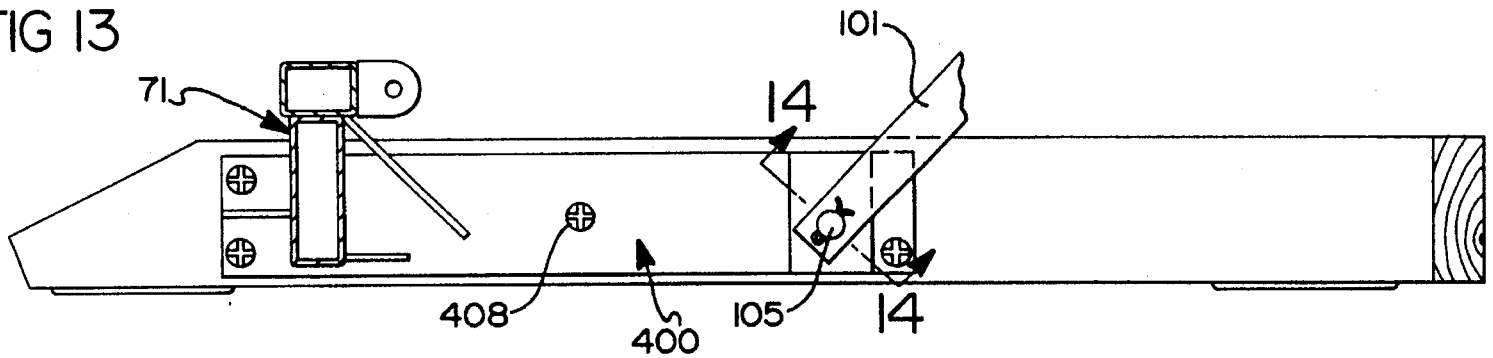
FIG. 13 is a side view of the portion of the lift base assembly shown in FIG. 12.

Referring now to FIGS. 12 and 13, a metal, reinforcing attachment plate 400 is shown for helping to secure the transverse pivot bracket member 71 and the pivot pin 105 to each wooden side rail 35. The attachment plate 400 comprises a first portion 402 and a second portion 404 which are separated by a protruding portion 406. The portions 402 and 404 are secured via a plurality of threaded screws 408 to the wooden side rail 35 to provide even further added rigidity to the wooden side rail 35 between points 410 and 412 along the side rail 35. The protruding portion 406 allows a small degree of clearance for the pivot pin. The pivot pin 105 further has an increase in diameter of about 33 percent for added structural support of the side leg 101 on each side of the chair 3.

Figure 14:
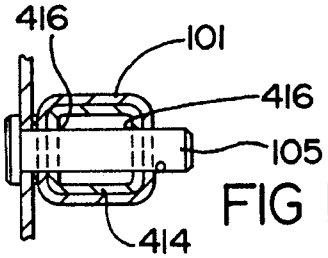
FIG. 14 is a cross sectional view of one of the tubular side legs showing how the side leg has been reinforced by the placement of an inner tubular member coaxially therein, and further showing an enlarged pivot pin for even better structurally supporting the tubular side leg for pivotal movement relative to the wooden side rails.

Referring now to FIG. 14, an alternative preferred form of the side leg 101 is shown. In this embodiment the side leg 101 includes of inner tubular member 414 which is welded or otherwise securely fixed in place inside the side leg 101. The inner tubular member 414 may vary in length but preferably comprises a length of at least about two inches. The inner tubular member 414 further includes a pair of openings 416 in alignment with one another to allow the pivot pin 105 to pass therethrough. Incorporating the inner tubular member 414 effectively doubles the cross sectional thickness of the side leg 101 which allows each side leg to even better handle the stress and torque incurred during operation of the chair 3. Most advantageously, this increase in strength is accomplished without requiring the entire length of the side leg 101 to be increased.

Figure 16:
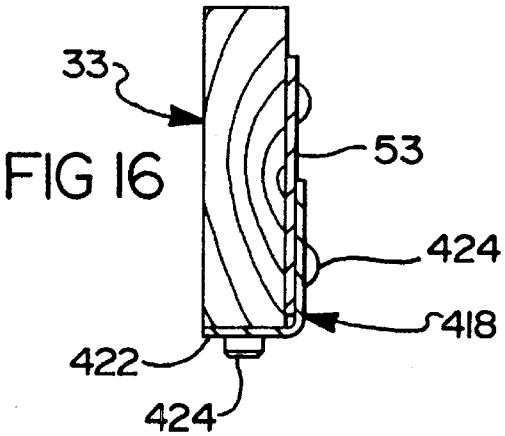
FIG. 16 is a cross sectional view of the upper frame member showing the angle bracket secured thereto in accordance with section line 16—16 in FIG. 15.
Figure 15:
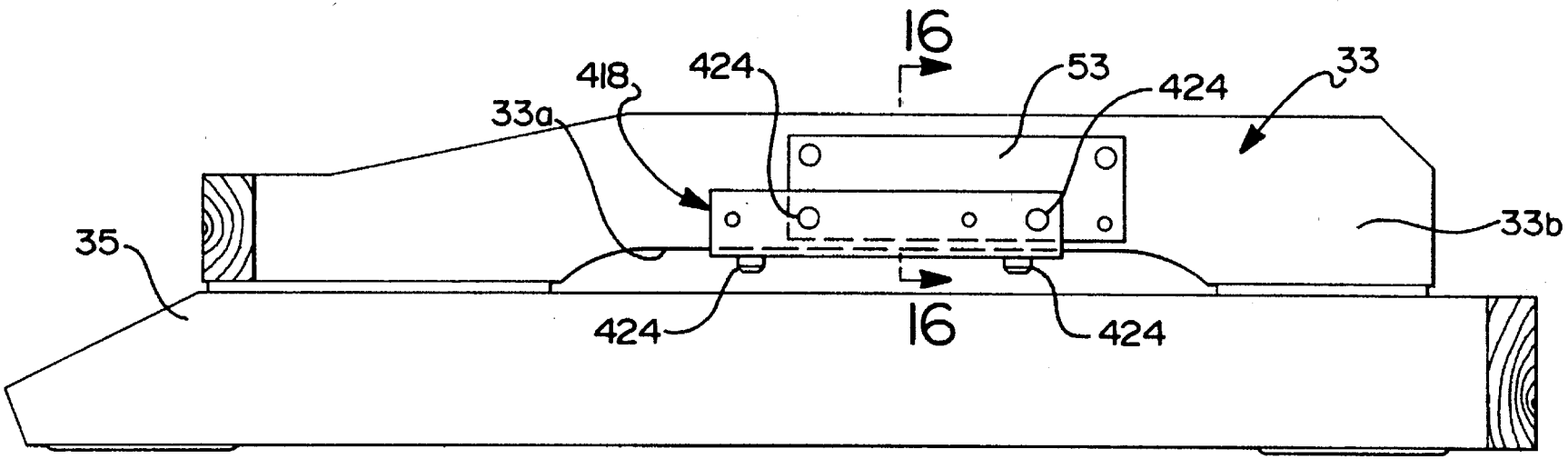
FIG. 15 is a side view of a portion of the lift base assembly showing an angle bracket for supporting the upper frame member of the power assisted chair in a manner which "cradles" the upper frame member.

Referring now to FIG. 15, yet another structural improvement is illustrated in the form of an angle bracket 418. The angle bracket 418 is adapted to "cradle" or support a bottom surface 33*a* of the upper frame member 33. With brief reference to FIG. 16, the angle bracket 418 includes a first portion 420 and a second portion 422 extending generally perpendicularly from the first portion 420. The first portion 420 is secured to the upper frame member 33 over the side plate 53 so as to help "clamp" the side plate 53 to the upper frame member 33. The angle bracket 418 is secured via conventional threaded screws 424 to the bottom surface 33*a* and a side surface 33*b* of the upper frame member 33. The angle bracket 418 thus even more securely supports the upper frame member 33 over simply using threaded fasteners such as threaded screws only in the side surface 33*b* of the upper frame member 33, and only through the side plate 53.

Referring now to FIG. 17, an alternative preferred embodiment of the spacer bars 266 and 290 and the nylon rollers 268 and 291 (FIG. 7) is shown. The modified spacer bars are designated by reference numerals 426 and 428. The modified cam followers are designated by reference numerals 430 and 432. The modified spacer bars 426 and 428 have each been lengthened by approximately 60 percent over the spacer bars 260 and 286, respectively, for significant added strength and rigidity. Each of the modified spacer bars 426 and 428 is shorter, width-wise, than their corresponding spacer bars 266 and 290 as shown in FIG. 7. This provides a greater lateral spacing between the cam followers 430 and 432 which in turn allows wider cam followers 430 and 432 to be incorporated. The cam followers 430 and 432 are approximately 10 percent to 15 percent wider than the rollers 268 and 291. This helps to reduce the stress on the cam followers 430 and 432 during operation of the claim 3.

Referring now to FIGS. 18 and 19, still another structural enhancement is illustrated. A metal reinforcing member 434 is placed on one side of each of the chair frame side members 140. A threaded bolt is then placed through an opening 436 in each side member 140 to effectively clamp a portion of a bracket used to interconnect the front portions 140*a* (FIG. 18) of the generally parallel disposed side members 140 together. In this manner the stress on the side members 140 is reduced by the "clamping" action effected by the metal reinforcing member 434.

Accordingly, those of ordinary skill in the art will appreciate that the above-described structural reinforcing elements described in connection with FIGS. 12–19 even further enhance the structural rigidity of the linear actuation mechanism of the present invention.

Another feature of the present invention is the use of wax on any wood surface which makes contact with any metal part. The use of wax has been found to be effective in preventing "squeaks" which could otherwise develop over time.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A power-assist chair comprising:

a base assembly;

a chair frame;

a single piece attachment plate for pivotally supporting said base assembly on said chair frame;

a rotatable drive shaft extending transversely between opposite side portions of said chair frame;

a leg rest assembly supported from said chair frame and operatively coupled to said drive shaft for movement from a retracted position to an extended position in response to rotation of said drive shaft in a first direction;

follower means supported for pivotal movement on said base assembly and operably interconnected to said drive shaft; and actuation means for actuating said leg rest assembly, said actuation means including a driven member, power operated means for causing movement of said driven member relative to said follower means, and a cam member supported for pivotable movement on said driven member, said cam member adapted to engage and pivot said follower means in response to movement of said driven member for causing corresponding rotation of said drive shaft in said first direction so as to extend said leg rest assembly.

2. A method for controlling movement of a power assisted recliner chair having a seat, a seatback, a leg rest assembly, an operator controllable reversible drive motor, a linear actuating member operably associated with said drive motor so as to be moveable in response to operation of said drive motor, a camming member coupled to said linear actuating member so as to be moveable in response to movement of said linear actuating member, and cam follower means operatively interconnected with said seatback and said leg rest assembly and engageable with said camming member, the method comprising the steps of:

a) causing said camming member to be moved generally longitudinally in a first direction by said linear actuating member from a home position in response to operation of said drive motor;

b) causing said cam follower means to engage said camming member at a first predetermined point of general longitudinal travel of said camming member in said first direction to urge said leg rest assembly into an extended position; and c) causing said cam follower means to engage said camming member at a second point of general longitudinal travel of said camming member in said first direction to cause said seatback to be reclined relative to a floor.

3. The method of claim 2, further comprising the step of:

causing said camming member to be driven in a second generally longitudinal direction generally opposite to said first direction, from said home position, to cause said seat of said recliner chair to be elevated relative to said floor.

4. The method of claim 3, further comprising the step of:

causing, when said seat is in an elevated position relative to said floor, said camming member to be driven in said first direction towards said home position to cause said seat to be lowered relative to said floor.

5. The method of claim 2, wherein said step of paragraph b) comprises the steps of:

providing that said cam follower means includes a first follower member and a second follower member;

causing said first follower member to engage said camming member at said first predetermined point of general longitudinal travel in said first direction to thereby urge said leg rest assembly into said extended position; and causing said second follower member to engage said camming member at said second predetermined point of general longitudinal travel to thereby cause said seatback to be urged into said reclined position.

6. A method for controlling movement of a power assisted recliner chair having a seat, a seatback, a leg rest assembly, an operator controllable reversible drive motor, a screw shaft operably associated with said drive motor so as to be rotatable in clockwise and counterclockwise directions in response to operation of the drive motor, a camming member threadably engaged with the screw shaft such that rotational movement of the screw shaft by the drive motor causes general longitudinal movement of the camming member, and a cam follower assembly operatively interconnected with the seatback and the leg rest assembly and engageable with the camming member, the method comprising the steps of:

a) causing the camming member to be moved generally longitudinally in a first direction from a home position by rotational movement of the screw shaft imparted by operation of the drive motor;

b) causing the cam follower assembly to engage said camming member at a first predetermined point of general longitudinal travel of said camming member in said first direction to urge said leg rest assembly into an extended position;

c) causing said cam follower assembly to engage said camming member at a second point of general longitudinal travel of said camming member in said first direction to cause said seatback to be reclined relative to a floor; and d) causing said camming member to be driven in a second generally longitudinal direction generally opposite to said first direction, toward said home position, to cause said seatback of said recliner chair to be urged into an upright position and said leg rest assembly to be retracted.

7. The method of claim 6, wherein the step of causing the cam follower assembly to engage said camming member at a first predetermined point of general longitudinal travel of said camming member in said first direction to urge said leg rest assembly into an extended position comprises causing a first cam follower of said cam follower assembly to engage said camming member at said first predetermined point; and wherein the step of causing said cam follower assembly to engage said camming member at a second point of general longitudinal travel of said camming member in said first direction to cause said seatback to be reclined relative to a floor comprises the step of causing a second cam follower member of said cam follower assembly to engage said camming member at said second predetermined point of general longitudinal travel.

8. The method of claim 6, further comprising the steps of:

causing said camming member to be driven in said second direction from said home position to a third predetermined position to urge said seat into an elevated position relative to a floor supporting said recliner chair; and when said seat is in said elevated position relative to said floor, causing said camming member to be driven in said first direction towards said home position to cause said seat to be lowered relative to said floor.

* * * * *

UNITED STATES PATENT AND TRADEMARK OFFICE

CERTIFICATE OF CORRECTION

PATENT NO. : 5,482,350
DATED : January 9, 1996
INVENTOR(S) : Karl J. Komorowski, et al.

It is certified that error appears in the above-indentified patent and that said Letters Patent is hereby corrected as shown below:

On the Title Page under "Notice"

"4,993,777" should be -- 5,061,010 --.

On the Title Page under U.S. Patent Documents, reference 3,218,102;

"Specketer" should be -- La Monte Specketer --.

On the Title Page under Attorney, Agent, or Firm

"Harness, Dickey & Pierce" should be -- Harness, Dickey & Pierce, P.L.C. --.

Column 5, line 40. "pans" should be -- parts --.
Column 11, line 10, "31 2" should be -- 312 --.

Signed and Sealed this

Fifth Day of November, 1996

*Attest:*

*Attesting Officer*

BRUCE LEHMAN

*Commissioner of Patents and Trademarks*